US007676184B2

(12) United States Patent
Murayama et al.

(10) Patent No.: US 7,676,184 B2
(45) Date of Patent: Mar. 9, 2010

(54) DEVELOPING APPARATUS

(75) Inventors: Shin Murayama, Hyogo (JP); Shuuichi Nakagawa, Osaka (JP); Ryuji Inoue, Hyogo (JP); Yuji Nagatomo, Osaka (JP); Shintaro Yamada, Tokyo (JP); Kazushige Oonishi, Tokyo (JP); Hirobumi Ooyoshi, Tokyo (JP); Tomofumi Yoshida, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 112 days.

(21) Appl. No.: 11/948,287

(22) Filed: Nov. 30, 2007

(65) Prior Publication Data

US 2008/0145109 A1 Jun. 19, 2008

(30) Foreign Application Priority Data

| | | |
|---|---|---|
| Dec. 4, 2006 | (JP) | 2006-327004 |
| Dec. 7, 2006 | (JP) | 2006-331066 |
| Jan. 18, 2007 | (JP) | 2007-008672 |
| Feb. 6, 2007 | (JP) | 2007-026789 |

(51) Int. Cl.
*G03G 15/08* (2006.01)

(52) U.S. Cl. ..... 399/260; 399/120; 399/255; 399/262; 399/263

(58) Field of Classification Search ..... 399/111, 399/120, 254, 255, 256, 258, 260, 262, 263; 222/DIG. 1
See application file for complete search history.

(56) References Cited

U.S. PATENT DOCUMENTS

| | | | | |
|---|---|---|---|---|
| 5,012,289 A | | 4/1991 | Aldrich et al. | |
| 5,659,859 A | * | 8/1997 | Kikuta et al. | 399/256 |
| 5,963,766 A | * | 10/1999 | Okuno et al. | 399/256 |
| 6,281,961 B1 | * | 8/2001 | Sako et al. | 355/27 |

(Continued)

FOREIGN PATENT DOCUMENTS

| | | |
|---|---|---|
| JP | 1-292375 | 11/1989 |

(Continued)

OTHER PUBLICATIONS

U.S. Appl. No. 12/170,842, filed Jul. 10, 2008, Kubota, et al.

(Continued)

*Primary Examiner*—David P Porta
*Assistant Examiner*—Benjamin Schmitt
(74) *Attorney, Agent, or Firm*—Oblon, Spivak, McClelland, Maier & Neustadt, L.L.P.

(57) ABSTRACT

A developing apparatus is disclosed that includes a developer carrier for carrying a developer used for developing a latent image, a developer supplying chamber having a developer supplying member for supplying the developer to the developer carrier by rotation, a developer storing chamber positioned above the developer supplying chamber for storing the developer and supplying the developer to the developer supplying chamber, and a partitioning member positioned between the developer supplying chamber and the developer storing chamber. The partitioning member has an opening through which the developer is supplied from the developer storing chamber to the developer supplying chamber. The developing apparatus includes a conveying member positioned above the partitioning member for conveying the developer in a substantially horizontal direction. The conveying member has an opening facing part situated directly above the opening for conveying the developer with less force than the other parts of the conveying member.

12 Claims, 22 Drawing Sheets

U.S. PATENT DOCUMENTS

| | | | | |
|---|---|---|---|---|
| 6,671,476 | B1 * | 12/2003 | Saiki | 399/111 |
| 2006/0280529 | A1 | 12/2006 | Nakagawa et al. | |
| 2007/0104523 | A1 | 5/2007 | Yoshida et al. | |
| 2007/0140763 | A1 | 6/2007 | Shimizu et al. | |
| 2007/0189812 | A1 | 8/2007 | Murayama et al. | |
| 2007/0248390 | A1 | 10/2007 | Kubota et al. | |

FOREIGN PATENT DOCUMENTS

| | | |
|---|---|---|
| JP | 6-64398 | 8/1994 |
| JP | 2001-194883 | 7/2001 |

OTHER PUBLICATIONS

U.S. Appl. No. 12/179,038, filed Jul. 24, 2008, Murayama, et al.

* cited by examiner

DEVELOPING APPARATUS

BACKGROUND OF THE INVENTION

1. Field of the Invention

The present invention relates to a developing apparatus used in an image forming apparatus such as a copier, a facsimile machine, a printer, a multi-function, and more particularly to a developing apparatus for developing a latent image on a latent image carrier by applying developer thereto.

2. Description of the Related Art

As a known image forming apparatus, there is, for example, a tandem type image forming apparatus which forms color images by superposing plural toner images of various colors with plural corresponding toner image forming parts (including, for example, a photoconductor and a developing apparatus) arranged in a horizontal direction. In the tandem type image forming apparatus, it is desired to reduce the interval between the plural toner image forming parts for achieving size-reduction of the image forming apparatus. Accordingly, in a known developing apparatus, a large space developer storing chamber for storing developer therein is provided above a developer supplying chamber having a roller for supplying the developer to a developing roller. This reduces the size in the horizontal direction of developing apparatus.

In one of the developing apparatuses having a developing roller and a supplying roller below the developer storing chamber, a partitioning member having a developer supplying port is provided between its developer storing chamber and the developer supplying chamber. Although this developing apparatus can supply developer from its developer storing chamber to its developer supplying chamber by gravity, the developer may be excessively supplied to the developer supplying chamber. In this case, the increase of pressure applied to the vicinity of the developing roller and the supplying roller by the weight of the developer may cause overfilling of developer in the developer supplying chamber. This causes the rotational torque of the developing roller and the supplying roller to increase and results in problems such as uneven image density or damage of gears due to uneven rotation of the developing roller and the supplying roller in the developing apparatus. Furthermore, the overfilling also adversely affects the flow in the developing apparatus. Accordingly, developer cannot be evenly supplied to the surface of the developing roller and results in poor image density due to an uneven layer of developer formed on the developing roller. Furthermore, in a case of using a developer with wax added for conducting oil-less fixation or low temperature fixation, the soft characteristic and the high aggregating property of the developer tend to promote the aforementioned problems.

In Japanese Laid-Open Patent Application No. 2001-194883, there is proposed an apparatus for reducing the size of the opening of the partitioning member between the developer supplying chamber and the developer storing chamber so that the developer supplied to the developer supplying chamber can be maintained in a suitable amount and prevent overfilling of developer in the developer supplying chamber. Furthermore, in Japanese Laid-Open Patent Application No. 2001-194883, a wing member is provided at a bottom part of the developer storing chamber for allowing a suitable amount of developer to be supplied from a developer supplying port by the rotation of the wing member. Accordingly, the developer supplied to the developer supplying chamber can be maintained in a suitable amount and this prevents overfilling of developer in the developer supplying chamber. However, since the consumption rate of developer varies, it is difficult to supply a suitable amount to the developer supplying chamber and prevent excessive supply to the developer supplying chamber. Furthermore, once the developer is excessively supplied to the developer supplying chamber, the developer supplying chamber may remain in such an excessively supplied state for a long period of time until the developer is consumed.

Furthermore, in the configuration where the developer supplying chamber and the developer storing chamber are partitioned by the partitioning member, the developer supplied to the developing roller circulates only inside the developer supplying chamber. This accelerates degradation of the developer in the developer supplying chamber and makes it difficult for the developer to maintain a consistent characteristic (e.g., charging property).

Japanese Laid-Open Patent Application No. 6-64398 discloses a developer apparatus having a roller provided in a connecting port between a developer storing chamber and a developer supplying chamber and plural flexible flaps (wings) arranged at the periphery of the roller. With this developing apparatus, developer is supplied from the developer storing chamber to the developer supplying chamber and also the developer is transported back to the developer storing chamber from the developer supplying chamber. By transporting the excessively supplied developer from the developer supplying chamber back to the developer storing chamber, the overfilling of developer in the developer supplying chamber can be prevented. Furthermore, since the developer can circulate between the developer supplying chamber and the developer storing chamber, the degradation of developer in the developer supplying chamber can be prevented. However, the roller provided at the connecting port between the developer supplying chamber and the developer storing chamber and the flexible flaps have a complicated shape and require to be precisely positioned for supplying/transporting the developer. Furthermore, with the developing apparatus, it is difficult to attain endurance and maintain consistency with time.

From another aspect, as one type of developing apparatus, there is a developing apparatus that develops a latent image on a latent image carrier by using a developer carrier that carries developer supplied from a developer supplying member. In this type of developing apparatus, the developer carrier and the developer supplying member (supplying roller) for supplying developer to the developer carrier are provided inside a developer storing chamber of the developing apparatus. In this developing apparatus, the developer storing chamber is long in a horizontal direction according to a cross-sectional view in the axial direction and has a conveying member for conveying the developer inside the developer storing chamber in the horizontal direction for supplying a suitable amount of developer to the supplying roller.

Meanwhile, in recent years and continuing, a tandem type image forming method is used by color image forming apparatuses for achieving high speed printing. As described above, in the tandem type image forming method, plural sets of latent image carriers (e.g., photoconductors) and developing apparatuses for developing the latent images on the latent image carriers are successively aligned for superposing images of different colors and transferring the superposed images onto an intermediary transfer belt or a sheet of paper. Thereby, a color image (e.g., full color image) can be formed. However, since such an image forming apparatus has plural sets of latent image carriers and developing apparatuses aligned in a horizontal direction where each developing apparatus has a developer storing chamber which is long in the horizontal direction, the image forming apparatus requires a large amount of space in the horizontal direction, thereby resulting in an image forming apparatus which is oversized in the horizontal direction.

As another type of developing apparatus, there is a developing apparatus having a developer storing chamber which is longer than it is wide. This developing apparatus supplies developer to the supplying roller by utilizing the weight of the developer in the developer storing chamber situated above the supplying roller. This configuration reduces the space in the horizontal direction. However, with this configuration, the developer falling onto and accumulating on the supplying roller leads to problems such as increase of torque of the supplying roller and wear of the supplying roller. Furthermore, the toner on the supplying roller may aggregate and lead to uneven image density. These problems may easily occur in a case where wax is contained in the particles of the toner for achieving oil-less fixation or low temperature fixation. Since this type of toner is relatively soft and has particles with a relatively high adhering property, the toner easily aggregates on the supplying roller.

In the aforementioned Japanese Laid-Open Patent Application No. 2001-194883, the developing apparatus has a first storing chamber including a developer carrier and a supplying roller, a second storing chamber for containing a large amount of toner, and a partitioning wall having plural supplying ports. The partitioning wall serves to reduce the pressure applied to the supplying roller by the weight of the developer and prevent problems such as increase of torque of the supplying roller and wear of the supplying roller. Furthermore, the plural supplying ports provided in the partitioning wall allow a suitable amount of toner to fall onto the supplying roller.

However, with the developing apparatus of Japanese Laid-Open Patent Application No. 2001-194883, there is a difference in the amount of developer conveyed from the area facing the supplying port and the amount of toner conveyed from the areas other than the area facing the supplying port. Therefore, the developer cannot be evenly applied to the surface of the supplying roller in the axial direction.

Accordingly, in order to evenly apply toner to the surface of the supplying roller in the axial direction, a conveying member may be provided between the supplying roller and the supplying port for conveying the toner in the axial direction. Furthermore, by providing the conveying member, the toner in the first storing chamber can be agitated, to thereby prevent toner from aggregating.

However, since the toner in the area directly below the supplying port is conveyed in the axial direction, a space (gap) is created in the first storing chamber at the area directly below the supplying port. In order to fill this space, developer from the second storing chamber is supplied (supplemented) to the space via the supplying port. As a result, toner is excessively supplied to the first storing chamber and overfills the first storing chamber. This results in problems such as aggregation of toner, increase of torque of the supplying roller, and uneven image density.

Furthermore, as another conventional developing apparatus, Japanese Laid-Open Patent Application No. 1-292375 discloses a developing apparatus having a developer supplying port provided at a bottom part of a developer storing container above a developer supplying chamber. However, in this developing apparatus as well as the above-described conventional developing apparatuses, except for the vicinity of an opening formed in a partitioning member between the developer storing chamber and the developer supplying chamber, toner tends to remain (accumulate) at a partitioning member. Thus, toner cannot be efficiently used to the end.

SUMMARY OF THE INVENTION

The present invention may provide a developing apparatus that substantially obviates one or more of the problems caused by the limitations and disadvantages of the related art.

Features and advantages of the present invention are set forth in the description which follows, and in part will become apparent from the description and the accompanying drawings, or may be learned by practice of the invention according to the teachings provided in the description. Objects as well as other features and advantages of the present invention will be realized and attained by a developing apparatus particularly pointed out in the specification in such full, clear, concise, and exact terms as to enable a person having ordinary skill in the art to practice the invention.

To achieve these and other advantages and in accordance with the purpose of the invention, as embodied and broadly described herein, an embodiment of the present invention provides a developing apparatus including a developer carrier for carrying a developer used for developing a latent image, a developer supplying chamber having a developer supplying member for supplying the developer to the developer carrier by rotation, a developer storing chamber positioned above the developer supplying chamber for storing the developer and supplying the developer to the developer supplying chamber, and a partitioning member positioned between the developer supplying chamber and the developer storing chamber, the partitioning member having an opening through which the developer is supplied from the developer storing chamber to the developer supplying chamber, the developing apparatus including: a conveying member positioned above the partitioning member for conveying the developer in a substantially horizontal direction; wherein the conveying member has an opening facing part situated directly above the opening for conveying the developer with less force than the other parts of the conveying member.

Furthermore, another embodiment of the present invention provides a developing apparatus including a developer carrier for carrying a developer used for developing a latent image, a first storing chamber for storing the developer, a developer supplying member for supplying the developer to the developer carrier by rotation, a second storing chamber positioned above the first storing chamber for supplying the developer to the first storing chamber, and a supplying port positioned between the first and second storing chambers for allowing developer to fall from the second storing chamber to the first storing chamber, the developing apparatus including: a conveying member provided between the supplying port and the developer supplying member for conveying the developer from the supplying port in an axial direction; wherein the conveying member has a supplying port facing part positioned directly below the supplying port for conveying a lesser amount of developer than the other parts of the conveying member.

Furthermore, another embodiment of the present invention provides a developing apparatus including a developer carrier, a supplying chamber for supplying the developer to the developer carrier, and a storing chamber positioned above the supplying chamber for storing the developer; the developing apparatus including: a partitioning member positioned between the supplying chamber and the storing member, the partitioning member having a supplying port for supplying the developer from the developer storing chamber to the developer supplying chamber and a returning port for returning the developer from the developer supplying chamber to the developer storing chamber; a first rotating member provided in the storing chamber for conveying the developer in an axial direction; a second rotating member provided in the supplying chamber for conveying the developer in the axial direction; wherein the second rotating member is positioned directly below the returning port; wherein the second rotating member has a plurality of wings having inclinations that are inverted at an area directly below the returning port.

Other objects and further features of the present invention will become apparent from the following detailed description when read in conjunction with the accompanying drawings.

DESCRIPTION OF THE PREFERRED EMBODIMENTS

In the following, embodiments of the present invention are described with reference to the accompanying drawings.

[Part 1]

Figure 1:
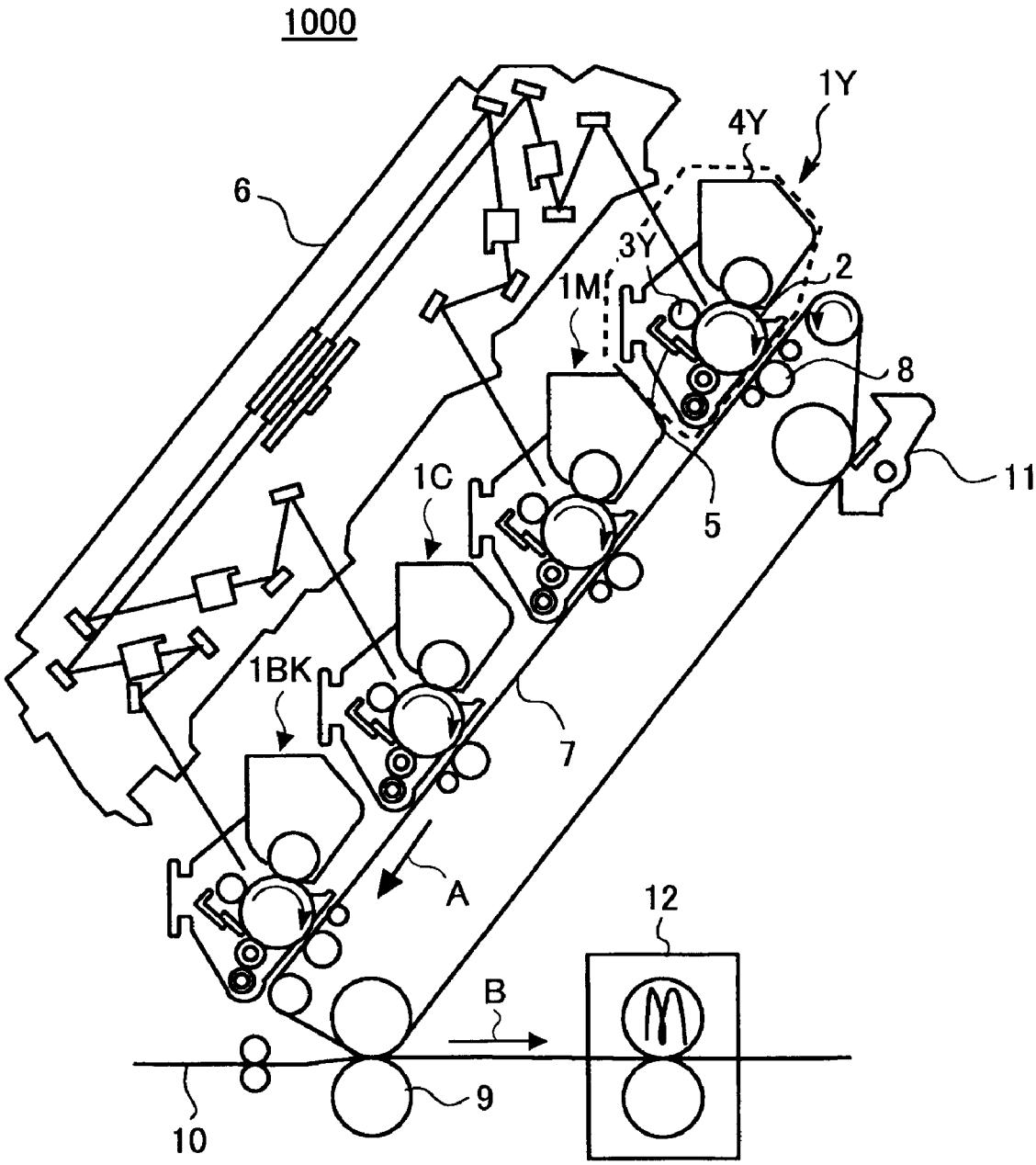
FIG. 1 is a schematic diagram showing an image forming apparatus according to an embodiment of the present invention.

FIG. 1 is a schematic diagram showing an image forming apparatus according to an embodiment of the present invention. According to this embodiment of the present invention, the image forming apparatus 1000 is a tandem type image forming apparatus for indirectly transferring images onto a recording medium. The image forming apparatus 1000 includes an intermediary transfer belt 7 serving as an endless belt having its surface moving (rotating) in the arrow direction shown in FIG. 1. Drum-shaped photoconductors 2 (2Y, 2M, 2C, 2Bk) for carrying toner images corresponding to Yellow, Magenta, Cyan, and Black (Y, M, C, Bk) are arranged above the intermediary transfer belt 7 in this order from an upstream side relative to the rotating direction of the intermediary transfer belt 7. Toner image forming parts including developing apparatuses are positioned at the peripheries of the photoconductors 2Y, 2M, 2C, 2Bk for forming toner images of corresponding colors. The toner image forming parts are integrally supported together with corresponding photoconductors 2Y, 2M, 2C, and 2Bk, to thereby form process cartridges 1 (1Y, 1M, 1C, 1Bk) that are detachably attached to a main body of the image forming apparatus 1000. The process cartridges 1Y, 1M, 1C, and 1Bk can be replaced by releasing corresponding stoppers (not shown). An optical writing apparatus 6 is positioned above the photoconductors 2Y, 2M, 2C, 2Bk. The optical writing apparatus 6 is for exposing and scanning a laser beam upon the surfaces of the photoconductors 2Y, 2M, 2C, 2Bk based on image data. Accordingly, electrostatic latent images corresponding to Y, M, C, and Bk can be formed on the photoconductors 2Y, 2M, 2C, and 2Bk. Although the optical writing apparatus 6 according to this embodiment of the present invention is a laser beam scanning type optical writing apparatus using a laser diode, the optical writing apparatus 6 may also use an array of LEDs. First transfer rollers 8 (8Y, 8M, 8C, 8Bk), which serve as first transferring parts, are provided at an inner side of the intermediary transfer belt 7 situated opposite to the photoconductors 2Y, 2M, 2C, 2Bk, respectively. The first transfer rollers 8Y, 8M, 8C, and 8Bk are for transferring toner images formed on the photoconductors 2Y, 2M, 2C, 2Bk to the intermediary transfer belt 7. Furthermore, a second transfer roller 9, which serves as a second transferring part, is provided at a position more downstream relative to the rotating direction of the intermediary transfer belt 7 than the process cartridges 1Y, 1M, 1C, and 1Bk. The second transfer roller 9 is for transferring an image formed on the intermediary transfer belt 7 onto a recording medium 10. Furthermore, a fixing apparatus 12 is provided at a position more downstream relative to a conveying direction of the recording medium 10 (arrow B in FIG. 1) than the second transfer roller 9. The fixing apparatus 12 is for fixing unfixed toner (unfixed toner image) onto the recording medium 10.

Besides the fact that each process cartridge 1Y, 1M, 1C, 1Bk uses a toner of a respective different color (Y, M, C, Bk) as an image forming material, the process cartridges 1Y, 1M, 1C, and 1Bk substantially have the same configuration. Accordingly, the operation and configuration of the process cartridges are hereinafter described without the indications of Y, M, C, and Bk.

Figure 2:
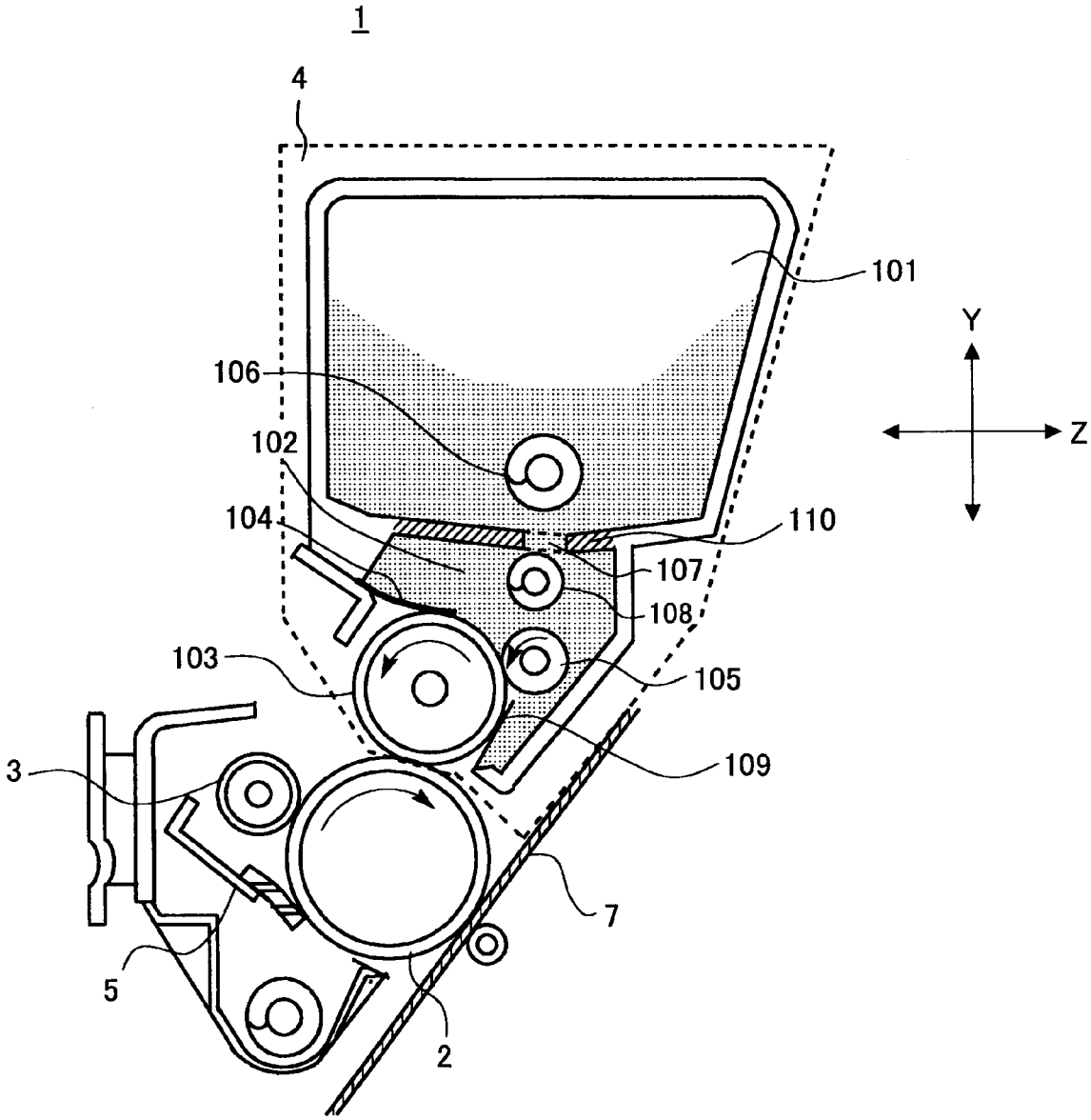
FIG. 2 is a schematic diagram showing a process cartridge according to an embodiment of the present invention.

FIG. 2 is a schematic diagram showing a configuration of the process cartridge 1 according to an embodiment of the present invention. The process cartridge 1 includes, for example, a charging member 3, a developing apparatus 4, and a cleaning blade 5 arranged in a manner surrounding the photoconductor 2. The charging member 3, which is pressed against the surface of the photoconductor 2, subordinately rotates in correspondence with the rotation of the photoconductor 2. The charging member 3 has a predetermined bias applied by a high voltage power source (not shown), to thereby uniformly (evenly) charge the surface of the photoconductor 2. Although this embodiment of the present invention uses a roller shape charging member which charges the photoconductor 2 by contacting the photoconductor 2, a non-contact type charging member may be used for charging the photoconductor 2 without contacting the photoconductor 2. The developing apparatus 4, which uses a single component contact developing method, develops an electrostatic image on the photoconductor 2 to a toner image. Further details of the developing apparatus 4 are described below. The cleaning blade 5 removes residual toner remaining on the photoconductor 2 by contacting the surface of the photoconductor 2.

In FIG. 2, the surface of the photoconductor 2 (rotating in the arrow direction) is uniformly charged by the charging member 3 and exposed and scanned by a laser beam of the optical writing apparatus 6, to thereby form (carry) an electrostatic latent image thereon. Then, the electrostatic latent image is developed into a toner image by the developing apparatus 4. Then, the toner image is transferred (first transfer) from the photoconductor 2 at the first transfer roller 8 to the intermediary transfer belt 7 by applying a bias (first transfer bias) from a high voltage power source (not shown). After the first transfer is completed, the toner remaining on the surface of the photoconductor 2 is removed by the cleaning blade 5, so as to prepare for the next image forming operation. For each process cartridge 1 (1Y, 1M, 1C, 1Bk), a toner image is formed on a corresponding photoconductor 2 (2Y, 2M, 2C, 2Bk) and is successively transferred (first transfer) to the moving surface of the intermediary transfer belt 7. Thereby, a superposed image created by superposing images of four colors (hereinafter also referred to as "four color toner image") is formed on the intermediary transfer belt 7.

The four color toner image formed on the intermediary transfer belt 7 is conveyed to a position facing the second transfer roller 9 (second transfer position) in accordance with the surface movement of the intermediary transfer belt 7 and is transferred (second transfer) to the surface of the recording medium 10 delivered between the intermediary transfer belt 7 and the second transfer roller 9 having a predetermined voltage applied. After the four color toner image is transferred onto the surface of the recording medium 10, the four color toner image having heat and pressure applied by the fixing apparatus 12. Accordingly, the four color toner image is fixed to the recording medium 10, to thereby obtain a full color image. A developing agent (developer) not being transferred by the second transfer roller and remaining on the surface of the intermediary transfer belt 7 is removed from the surface of the intermediary transfer belt 7 by a transfer belt cleaning part 11.

Figure 3:
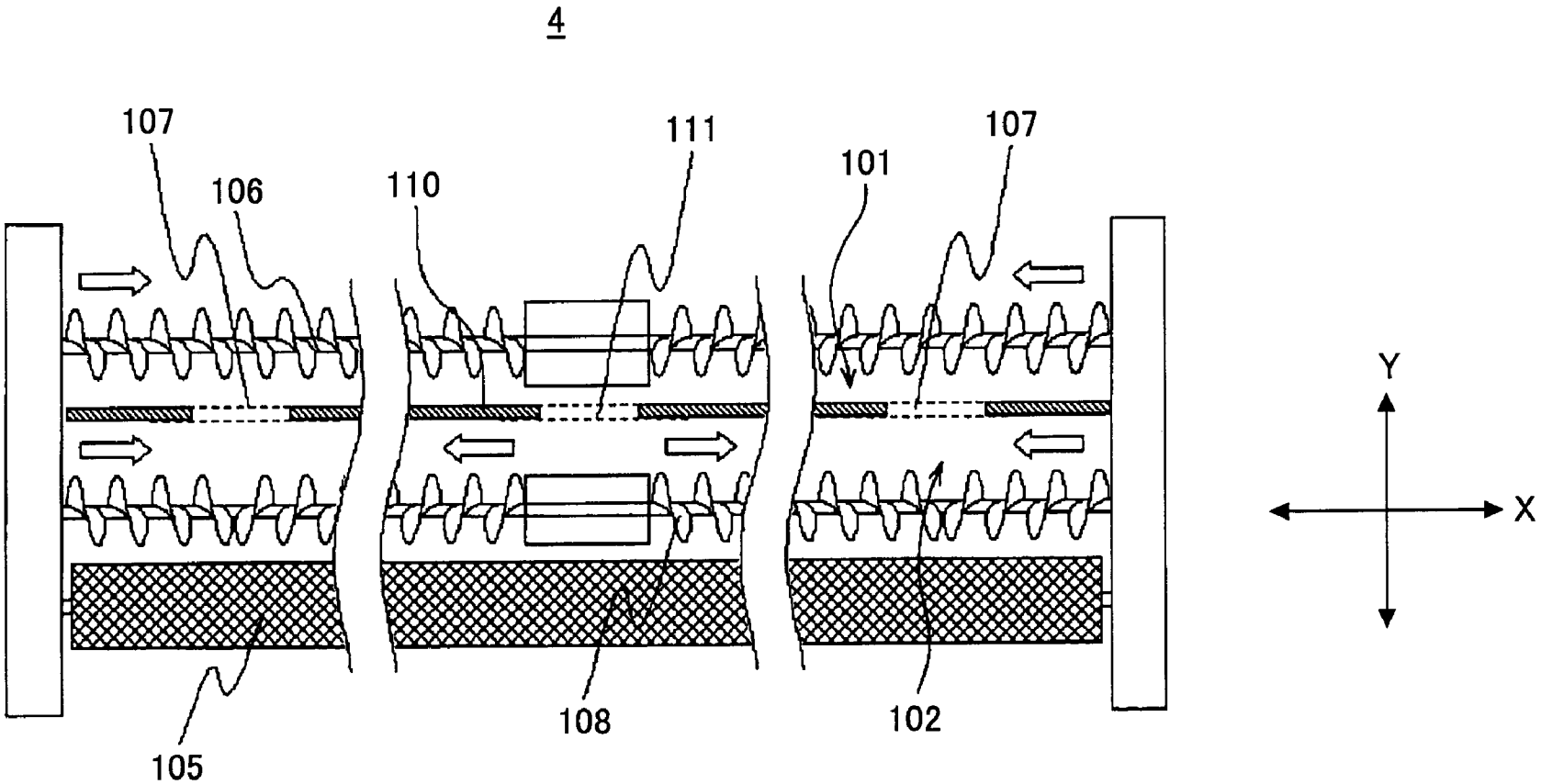
FIG. 3 is a front view of an inside configuration of a developing apparatus according to an embodiment of the present invention.

Next, the developing apparatus 4 according to an embodiment of the present invention is described in further detail. The developing apparatus 4 performs contact development by using a single component developer including a single component toner. The developing apparatus 4 includes, for example, a developing roller 103 acting as a developer carrier, a developer supplying chamber 102 including a supplying roller 105 acting as a supplying member for supplying a developer to the developing roller 103, a developer storing chamber 101 situated above the developer supplying chamber 102 for storing the developer, and a developer layer thickness restricting member 104 for restricting the thickness of the layer of the developer carried on the developing roller 103. FIG. 3 is a front view showing an internal configuration of the developing apparatus 4. A partitioning member 110 is provided between the developer storing chamber 101 and the developer supplying chamber 102 for partitioning the developer storing chamber 101 and the developer supplying chamber 102. The partitioning member 110 includes a supplying port 111 for supplying the developer from the developer storing chamber 101 to the developer supplying chamber 102 and a returning port 107 for returning the developer from the developer supplying chamber 102 to the developer storing chamber 101.

A storing chamber screw member 106 acting as a storing chamber developer agitating/conveying member is provided above the partitioning member 110 inside the developer storing chamber 101. The storing chamber screw member 106 is configured to agitate the developer while conveying the developer in a substantially horizontal direction of the developing apparatus 4 and substantially parallel to the rotating shaft of the storing chamber screw member 106 (arrow direction of FIG. 3). The storing chamber developer agitating/conveying member is not limited to the illustrated configuration of the storing chamber screw member 106. For example, the storing chamber developer agitating/conveying member may be a combination of a rotary member having a conveying function (e.g., screw, conveyor belt, coil) and a member having an agitating function (e.g., a planar member such as a wing or a flap, a paddle formed by bending a wire). Furthermore, the storing chamber developer agitating/conveying member may be configured as a rotary shaft with planar or sheet-like members attached for conveying the developer in a direction normal to a rotational arc of the storing chamber screw member 106.

The returning port 107 acts as a port for returning the developer, being excessively supplied to the developer supplying chamber 102, to the developer storing chamber 101. Furthermore, a supplying chamber screw member 108 acting as a supplying chamber developer agitating/conveying member is provided below the partitioning member 110 inside the developer supplying chamber 102. The supplying chamber screw member 108 is positioned in a manner extending directly below the returning port 107. The supplying chamber screw member 108 is rotatable for agitating the developer while conveying the developer in the direction of its rotational axis. Furthermore, at a portion of the supplying chamber screw member 108 located directly below the returning port 107, the inclinations of the flaps (wings) of the supplying chamber screw member 108 are inverted so that the developer can be conveyed toward the area directly below the returning port 107 from both sides with respect to the rotational axis direction of the supplying chamber screw member 108. Furthermore, the supplying chamber screw member 108 is operable to agitate the developer inside the developer supplying chamber 102. Furthermore, the supplying chamber screw member 108 is operable to supply the developer to the developing roller 103 and the supplying roller 105 situated therebelow.

The surface of the supplying roller 105 is covered by a cellular material having pores (cells). The cellular porous configuration of the supplying roller 105 serves to take (capture) the developer carried into the developer supplying chamber 102 by adhering the developer and also serves to prevent degradation of toner due to pressure concentrating at the contacting area with respect to the developing roller 103. A material having an electrical resistance of $10^3$ to $10^{14}$ Ω·cm is used as the cellular material. An offset voltage, which has the same polarity as the charging polarity of the developer with respect to the developing roller 103, is applied as a supplying bias to the supplying roller 105. The supplying bias applied to the supplying roller 105 works to press the preliminarily charged developer against the developing roller 103 at the contacting area between the supplying roller 105 and the developing roller 103. The polarity of the voltage applied to the supplying roller 105 is not limited to the aforementioned polarity. For example, depending on the type of developer, the voltage applied to the supplying roller 105 may have the same potential as the developing roller 103 or have an inverted polarity with respect to the developing roller 103. The supplying roller 105 according to an embodiment of the present invention rotates in a counter-clockwise direction, to thereby allow the developer adhered to its surface to coat (cover) the surface of the developing roller 103.

The developing roller 103 may be a roller covered by an elastic rubber layer. The developing roller 103 may further have the surface of the elastic rubber layer coated by a material having a characteristic of being easily charged to a polarity opposite to that of the developer. In order to maintain even contact with respect to the photoconductor (photoconductor drum) 2, the elastic rubber layer has a degree of hardness that is no greater than 50 degrees (JIS-A). Furthermore, in order for a developing bias to have effect, a material having an electrical resistance of $10^3$ to $10^{10}$ Ω·cm is used as the material of the developing roller 103. Furthermore, a material having a surface roughness of 0.2 to 2.9 μm (Ra) is used as the material of the developing roller 103 so that a necessary amount of developer can be retained (held) on the surface of the developing roller 103. Such developing roller 103 according to an embodiment of the present invention rotates in a counter-clockwise direction, to thereby allow the developer retained on its surface to be conveyed through the developer layer thickness restricting member 104 and finally to the position facing the photoconductor 2. The developing roller 103 according to an embodiment of the present invention is arranged in a manner contacting the photoconductor 102.

The developer layer thickness restricting member 104, which uses a metal (e.g., SUS304CSP, SUS301CSP, phosphor bronze) planar spring material, has one end contacting and applying pressure of 10-100 [N/M] to the surface of the developing roller 103. As the developer on the developing roller 103 passes through the developer layer thickness restricting member 104, the layer thickness of the developer is reduced and a charge is applied to the developer by the frictional electricity generated by the pressure applied by the developer layer thickness restricting member 104. In order to supplement the frictional electricity, a voltage being offset to the same polarity as the charging polarity of the developer with respect to the potential of the developing roller 103 is applied as a restriction bias to the developer layer thickness restricting member 104.

In the developing apparatus 4, the photoconductor 2 rotates in the clockwise direction and the developing roller 103 rotates in the counter-clockwise direction. The developing roller 103 has its surface moving in the same direction as that of the photoconductor 2 at the area facing (contacting) the photoconductor 2. Accordingly, the thin layer of developer on the surface of the developing roller 103 is conveyed to the area facing (contacting) the photoconductor 2 by the rotation of the developing roller 103 and is transferred to the surface of the photoconductor 2 according to the latent electric field created by the developing bias applied to the developing roller 103 and the electrostatic latent image formed on the photoconductor 2. Thereby, the developer is developed.

A sealing member (seal) 109 is provided in a manner contacting the developing roller 103 at a portion where residual developer (developer not developed onto the photoconductor 2) remaining on the developing roller 103 returns to the inside of the developer supplying chamber 102. This sealing member 109 seals the residual developer, so that the developer does not leak outside of the developing apparatus 4.

As described above, the supplying roller 105 and the supplying chamber screw member 108 are provided in this order from the bottom of the developer supplying chamber 102. Furthermore, the developer storing chamber 101 is positioned above the developer supplying chamber 102. The partitioning member 110 including the returning port 107 is interposed between the developer supplying chamber 102 and the developer storing chamber 101. Furthermore, the developer storing chamber 101 includes the storing chamber screw member 106 positioned above the partitioning member 110. Furthermore, the inclinations of the flaps (wings) of the supplying chamber screw member 108 located directly below the returning port 107 are inverted so that the developer can be conveyed toward the area directly below the returning port 107 from both sides with respect to rotational axis direction of the supplying chamber screw member 108. Accordingly, the developer portions conveyed from both sides continuously collide with each other at the area directly below the returning port 107. The collision of developer causes the direction of the conveying force to change from the axial direction (X direction) to a vertical direction (Y direction). Thereby, the developer accumulates and protrudes to form a mountain-like shape. As time passes, the protrusion 201 of the developer becomes higher, to thereby form a substantially conical shape. Accordingly, the developer is delivered to the developer storing chamber 101 via the returning port 107. The developer returning to the developer storing chamber 101 from the returning port 107 is successively conveyed from the area above the returning port 107 to the area above the supplying port 111. It is to be noted that the arrows illustrated in FIG. 3 indicate the conveying directions of the developer.

Furthermore, since the protrusion 201 of the developer is constantly formed by the developer conveyed from both sides by the supplying chamber screw member 108 at the area directly below the returning port 107, the developer inside the developer storing chamber 101 can be prevented from flowing into the developer supplying chamber 102. Accordingly, the developer inside the developer supplying chamber 101 can be constantly maintained at a suitable amount.

Furthermore, since the developer is circulated between the developer storing chamber 101 and the developer supplying chamber 102 inside the developing apparatus 4, the developer can be prevented from degrading inside the developer supplying chamber 102. Thus, the characteristics of the developer can be consistent.

Although the developer inside the developer storing chamber might flow into the developer supplying chamber 102 via the returning port 107 when the toner (developer) protrusion 201 cannot be formed by the rotation of the supplying chamber screw member 108 (e.g., immediately after toner is supplied into an empty developing apparatus 4 or where there is only a small amount of toner remaining in the developer supplying chamber 102 due to consumption of toner approaching the end of service life of the developing apparatus 4), the amount of developer flowing into the developer supplying chamber 102 is subtle and does not affect operations of the image forming apparatus 1000.

Figure 4A:
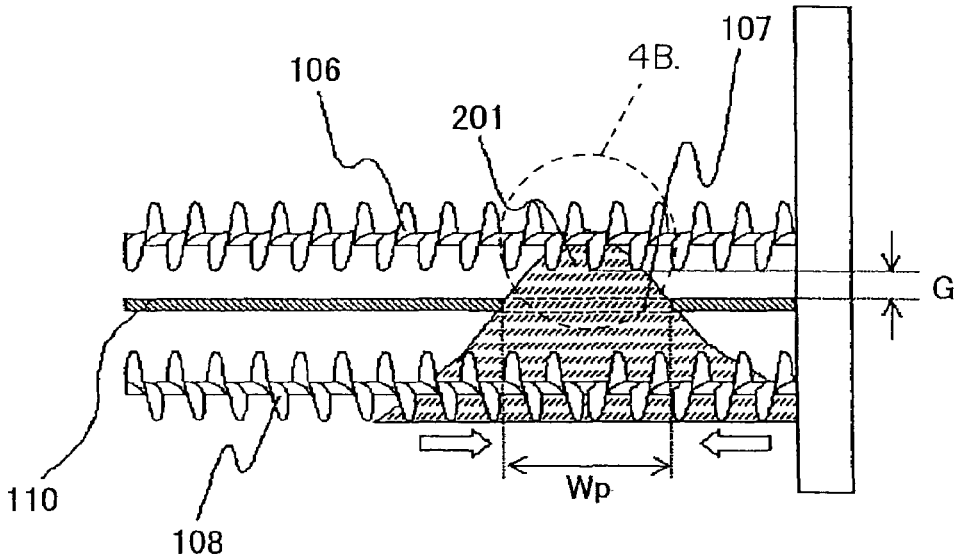
FIG. 4A is a schematic diagram for describing a positional relationship between the developer below a returning port and a supplying chamber screw member according to an embodiment of the present invention.
Figure 4B:
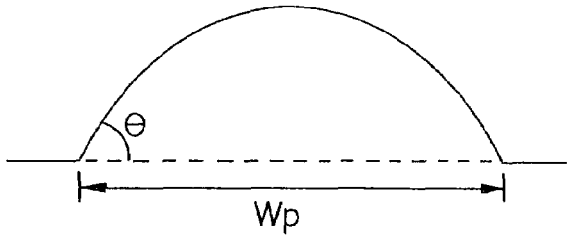
FIG. 4B is an enlarged view of a portion of FIG. 4A that illustrates the repose angle of the developer.

FIG. 4A is a schematic diagram for describing the positional relationship between developer situated directly below the returning port 107 and the storing chamber screw member 106 according to an embodiment of the present invention. In a case where the distance between the bottom part (bottom tip) of the storing chamber screw member 106 and the partitioning member (in this example, partitioning plate) 110 is indicated as "G", the maximum width of the opening of the returning port 107 in an axial direction (X direction) of the developing apparatus 4 (maximum opening width) is indicated as "Wp", and as can be seen in FIG. 4B, the repose angle of the developer is indicated as "θ", the width of the opening of the returning port 107 is set to satisfy a relationship of "θ>tan−1(2G/Wp)". In order for the storing chamber screw member 106 to convey the developer returned from the returning port 107, the height of the peak of the protrusion of the developer 201 is to reach at least the bottom tip of the storing chamber screw member. That is, the relationship of "θ>tan−1(G/Wp) is to be satisfied. In order to convey the developer more satisfactorily, it is preferable for the peak of the protrusion of the developer to be situated closer towards the rotational axis (center axis) of the storing chamber screw member 106. By satisfying the relationship of the "θ>tan−1 (2G/Wp)", the developer returning from the returning port 107 can reach the area enabling the storing chamber screw member 106 to convey the returning developer. Accordingly, the storing chamber screw member 106 can convey the returning developer and prevent the returning developer from accumulating above the returning port 107. Therefore, the developer can be efficiently returned from the developer supplying chamber 102 to the developer storing chamber 101.

Figure 5:
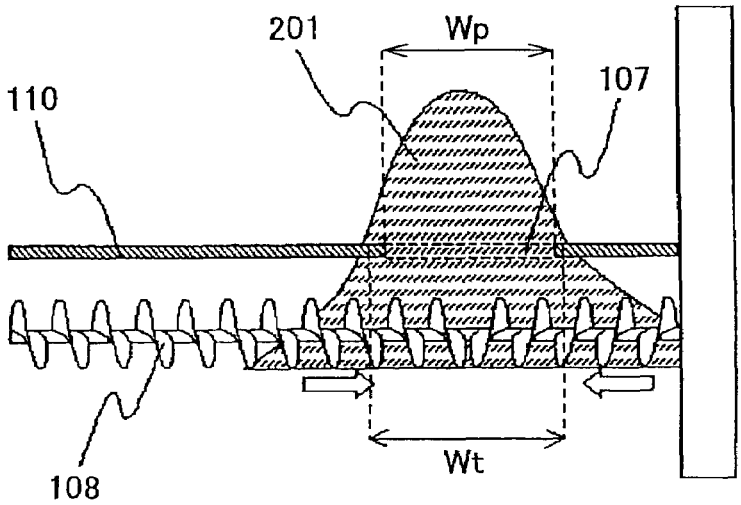
FIG. 5 is a schematic diagram for describing a relationship between a protrusion of a developer below a returning port and a maximum width of a returning port in an axial direction according to an embodiment of the present invention.

FIG. 5 is a schematic diagram for describing the relationship between the developer directly below the returning port 107 and the maximum opening width Wp of the returning port 107 in the axial direction (X direction). As described above, the supplying chamber screw member 108 conveys the developer to the area directly below the returning port 107 from both sides relative to its rotational axis direction, to thereby cause the developer to protrude in a mountain-like shape (protrusion 201) at the area directly below the returning port 107. The part of the protrusion 201 located at substantially the same height (Y direction) as the returning port 107 (partitioning part 110) is formed with a predetermined width (indicated as "Wt") in the axial direction (X direction). The pitch of the flaps (wings), the outer diameter, and the number of rotations of the supplying chamber screw member 108 are set so that the predetermined width Wt satisfies a relationship of "Wt>Wp". By satisfying the relationship of "Wt>Wp", the developer in the developer storing chamber 101 can be prevented from flowing into the developer supplying chamber 102. Thus, the developer inside the developer storing chamber 101 can be prevented from being excessively supplied to the developer supplying chamber 102.

Figure 6:
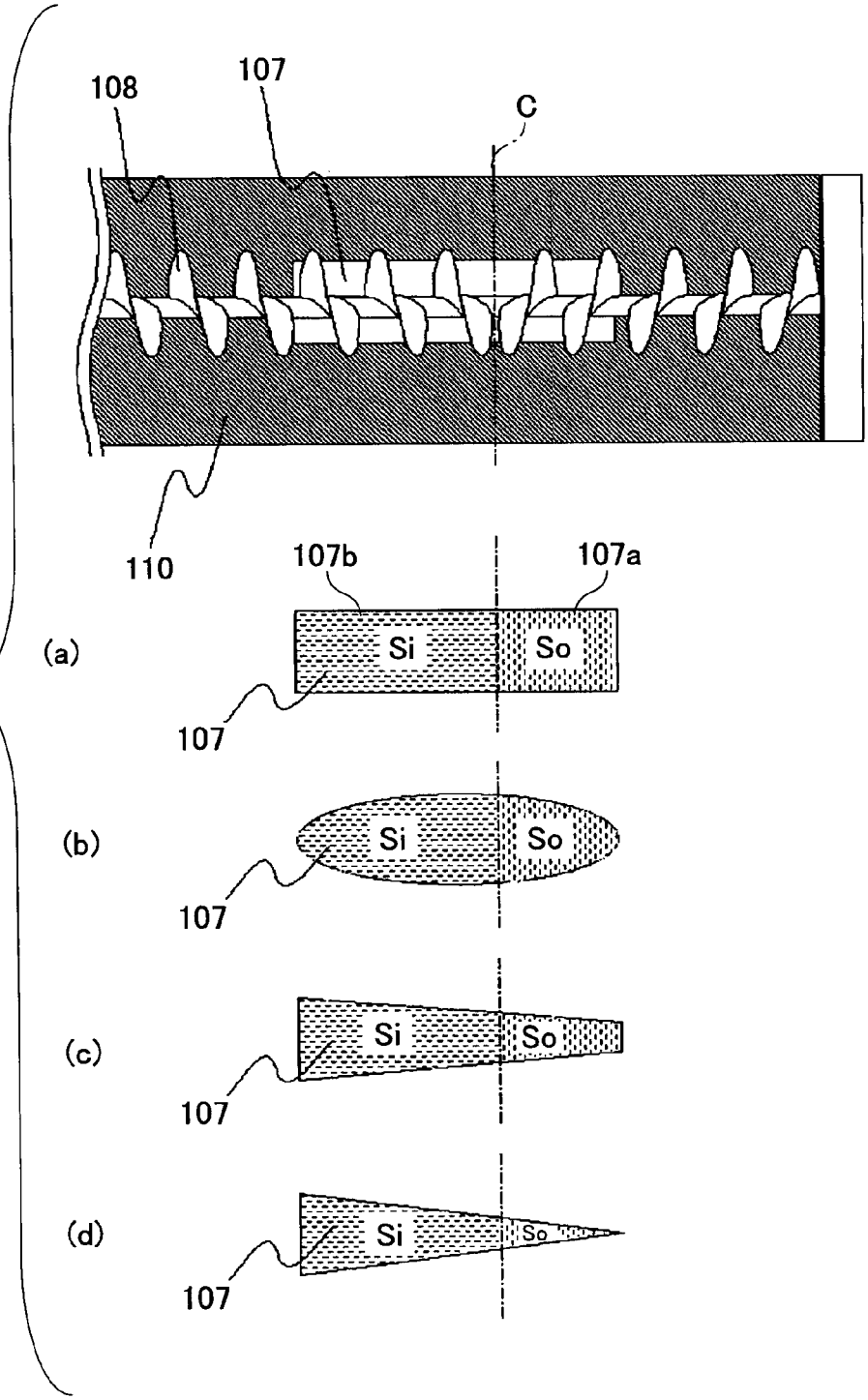
FIG. 6 is a bottom view of a returning port viewed from a supplying chamber screw member below the returning port according to an embodiment of the present invention.

FIG. 6 shows the returning port 107 when viewed from below the supplying chamber screw member 108. In FIG. 6, the dot-dash line illustrates a line C running through a merging point (colliding point) at the center of the inverted inclinations of the flaps (wings) of the supplying chamber screw member 108 for conveying the developer in a colliding direction from both sides in a case where the returning port 107 is view directly from above. FIGS. 6(*a*)-(*d*) show examples of the returning port 107 being divided by the dot-dash line C into an outward area 107*a* situated toward the end of the supplying chamber screw member 108 in the axial direction (X direction) and an inward area 107*b* situated towards the center of the supplying chamber screw member 108 in the axial direction (X direction). FIG. 6(*a*) shows a plan view of the returning port 107 having a rectangular shape, FIG. 6(*b*) shows a plan view of the returning port 107 having an oval shape, FIG. 6(*c*) shows a plan view of the returning port 107 having a trapezoidal (rhombus) shape, and FIG. 6(*d*) shows a plan view of the returning port 107 having a triangular shape. In a case where the size (area) of the opening of the outward area 107*a* is indicated as "So" and the size (area) of the opening of the inward area 107*b* is indicated as "Si", the returning port 107 is positioned to satisfy the relationship of "Si≧So". At the area directly below the returning port 107, the amount of developer conveyed from the side of the inward area 107*b* is greater than the amount of developer conveyed from the side of the outward area 107*a*. Thus, the opening of the inward area 107*b* and the opening of the outward area 107*a* are formed in sizes ("Si" and "So") that can counter the developer being conveyed in such manner. Thereby, developer can be efficiently returned from the developer supplying chamber 102 to the developer storing chamber 101. Alternatively, the returning port 107 may be formed in a tapered shape which satisfies the relationship of "Si≧So".

Figure 7:
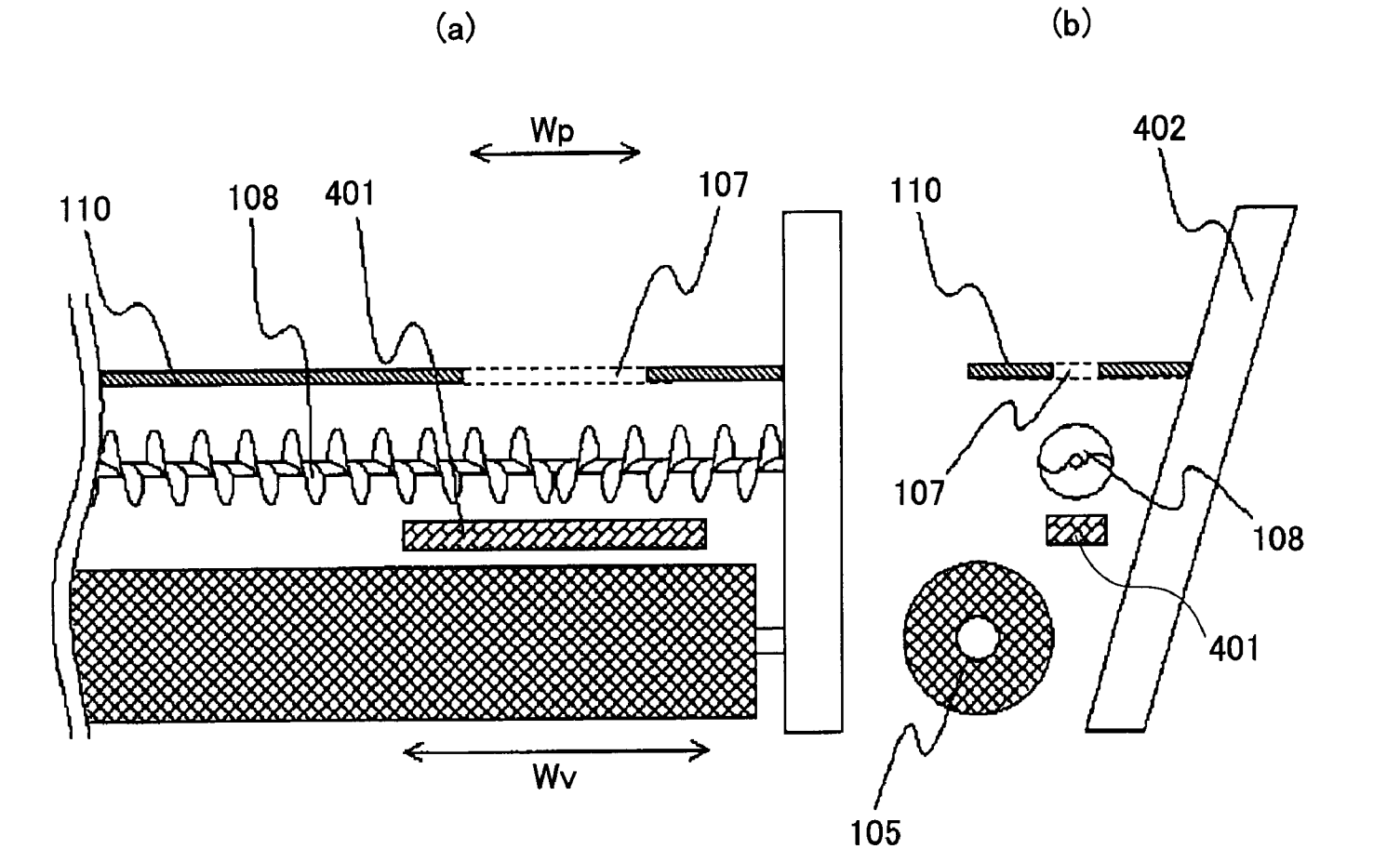
FIG. 7 is a schematic diagram showing a developer blocking member provided below a supplying chamber screw member according to an embodiment of the present invention.

FIG. 7 shows an embodiment of the present invention in which a developer blocking member 401 is provided below the supplying chamber screw member 108. More specifically, FIG. 7(*a*) is a front view showing a part of an internal configuration of the developing apparatus 4 and FIG. 7(*b*) is a side view of the internal configuration. The developer blocking member 401 is provided below the supplying chamber screw member 108 at a position to substantially correspond to the position of the returning port 107. In a case where the width of the developer blocking member 401 in the axial direction (X direction) is indicated as "Wv" and the maximum width of the opening of the returning port 107 is indicated as "Wp", the developer blocking member 401 is formed to satisfy a relationship of "Wv>Wp". By placing the developer 108 below the supplying chamber screw member 108, the conveying force of the supplying chamber screw member 108 oriented in the axial direction (X direction) can efficiently shift (convert) to a conveying force oriented in the direction toward the developer storing chamber 101 (Y direction). In other words, the developer being conveyed by the supplying chamber screw member 108 from both sides of the developing apparatus 4 can be prevented from being conveyed in the direction towards the supplying roller 105. Thereby, developer can be efficiently conveyed to the developer storing chamber 101.

Figure 8:
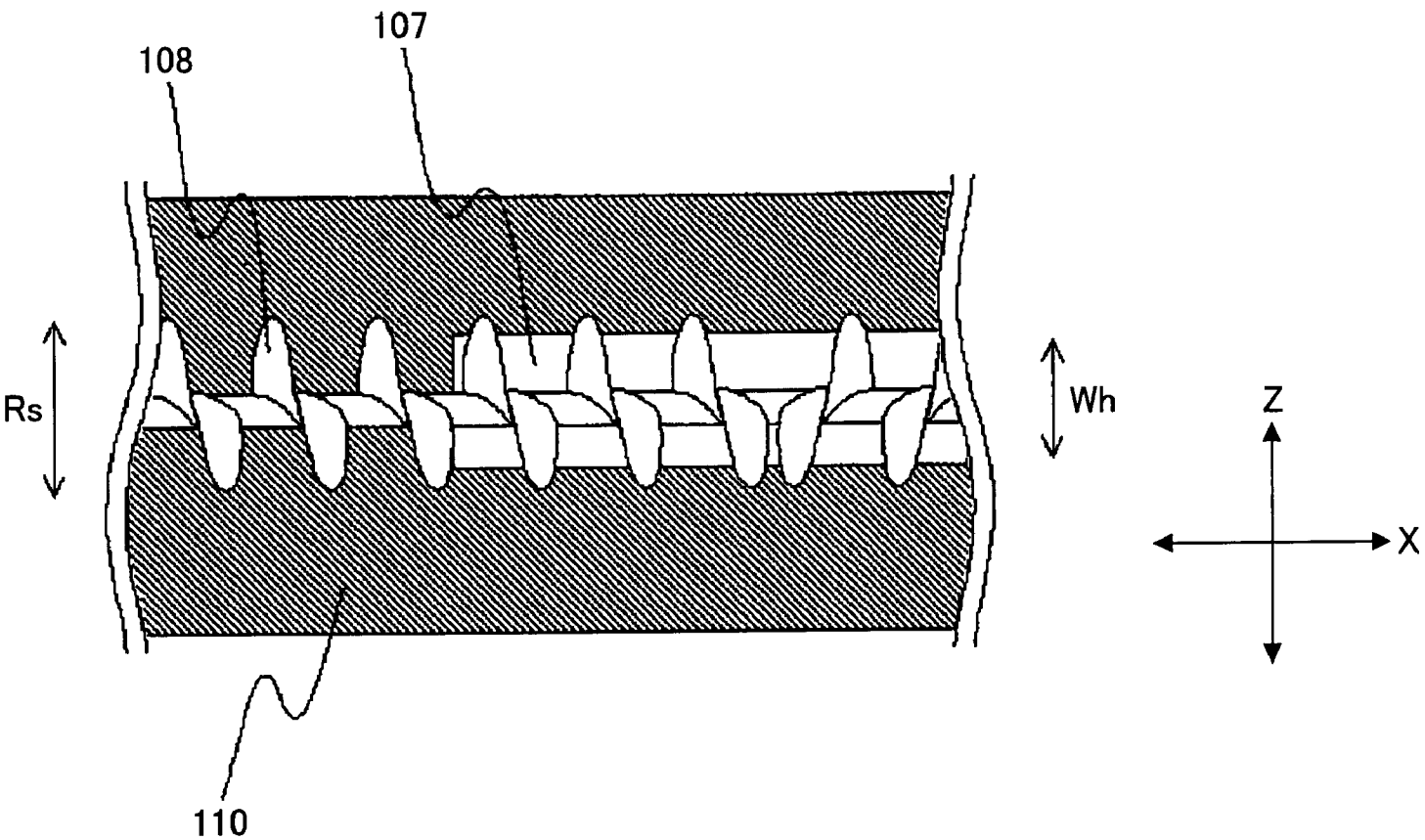
FIG. 8 is a schematic diagram for describing a relationship between a supplying chamber screw member and the width of the returning port in a direction perpendicular to an axial direction according to an embodiment of the present invention.

FIG. 8 is a schematic diagram for describing a relationship between the supplying chamber screw member 108 and the width of the returning port in a direction (Z direction) perpendicular to the axial direction. In a case where the outer diameter of the supplying chamber screw member 108 is indicated as "Rs" ("D") and the width of the returning port 107 in the Z direction (depth direction of the developing apparatus 4) is indicated as "Wh" ("Wd"), the supplying chamber screw member 108 and the returning port 107 are formed to satisfy the relationship of "Rs">Wh" ("D>Wd"). By maintaining the relationship of "Rs">Wh" ("D>Wd"), the developer being conveyed by the supplying chamber screw member 108 from both sides of the developing apparatus 4 can be efficiently guided from the developer supplying chamber 102 to the developer storing chamber 101.

Hence, as described above, according to an embodiment of the present invention, the partitioning member 110 is provided with the returning port 107 for returning developer from the developer supplying chamber 102 to the developer storing chamber 101, and the supplying chamber screw member 108 is arranged in a manner extending directly below the returning port 107. Furthermore, the inclinations of the flaps (wings) of the supplying chamber screw member 108 are inverted at the area directly below the returning port 107 so that developer can be conveyed from both sides towards the returning port 107. The developer portions being conveyed from both sides continuously collides with each other below the returning port 107 so that the conveying force in the axial direction (X direction) changes to a vertical direction (Y direction). The colliding developer accumulates and forms the protrusion 201. Thereby, a part of the protrusion 201 close to its peak enters the developer storing chamber 101 via the returning port 107. Therefore, in a case where the amount of developer in the developer supplying chamber 102 becomes excessive, the developer is returned to the developer storing chamber 101, so that the developer in the developer supplying chamber 102 can be maintained to be a suitable amount and prevented from overfilling of the developer supplying chamber 102. Since the mechanism for returning the developer can be obtained by simply changing the inclinations of the flaps (wings) of the supplying member screw member 108, the mechanism can be fabricated having a simple configuration and yet maintain a consistent performance with age.

Furthermore, in a case where the distance between the bottom part (bottom tip) of the storing chamber screw member 106 and the partitioning member (in this example, partitioning plate) 110 is indicated as "G", the maximum width of the opening of the returning port 107 in the axial direction (X direction) of the developing apparatus 4 (maximum opening width) is indicated as "Wp", and the repose angle of the developer is indicated as "θ", the width of the opening of the returning port 107 is set to satisfy a relationship of "θ>tan−1(2 G/Wp)". Thereby, the developer returning from the returning port 107 can reach the storing chamber screw member 106, so that the storing chamber screw member 106 can convey the returning developer and prevent the returning developer from accumulating above the returning port 107. Therefore, the developer can be efficiently returned from the developer supplying chamber 102 to the developer storing chamber 101.

Furthermore, the part of the protrusion 201 located at substantially the same height (Y direction) as the returning port 107 (partitioning part 110) is formed with a predetermined width (indicated as "Wt") in the axial direction (X direction). The pitch of the flaps (wings), the outer diameter, and the number of rotations of the supplying chamber screw member 108 are set so that the predetermined width Wt satisfies a relationship of "Wt>Wp". By satisfying the relationship of "Wt>Wp", the developer in the developer storing chamber 101 can be prevented from flowing into the developer supplying chamber 102. Thus, the developer inside the developer storing chamber 101 can be prevented from excessively supplied to the developer supplying chamber 102.

In a case where a line C running through a merging point (colliding point) of the developer flowing from both sides divides the returning port 107 at the center of the inverted inclinations of the flaps (wings) of the supplying chamber screw member 108 into an outward area 107*a* situated towards the end of the supplying chamber screw member 108 in the axial direction (X direction) and an inward area 107*b* situated towards the center of the supplying chamber screw member 108 in the axial direction (X direction), the returning port 107 is positioned to satisfy the relationship of "Si≧So" where the size (area) of the opening of the outward area 107*a* is indicated as "So" and the size (area) of the opening of the inward area 107*b* is indicated as "Si". Since the amount of developer conveyed from the side of the inward area 107*b* is greater than the amount of developer conveyed from the side of the outward area 107*a* at the area directly below the returning port 107, the opening of the inward area 107*b* and the opening of the outward area 107*a* are formed in sizes ("Si" and "So") that can counter the developer conveyed in such manner. Thereby, developer can be efficiently returned from the developer supplying chamber 102 to the developer storing chamber 101.

Furthermore, the developer blocking member 401 is provided below the supplying chamber screw member 108 at a position to substantially correspond to the position of the returning port 107. By placing the developer 108 below the supplying chamber screw member 108, the conveying force of the supplying chamber screw member 108 oriented in the axial direction (X direction) can efficiently shift (convert) to a conveying force oriented in the direction towards the developer storing chamber 101 (Y direction). In other words, the developer being conveyed by the supplying chamber screw member 108 from both sides of the developing apparatus 4 can be prevented from being conveyed in the direction towards the supplying roller 105. Thereby, developer can be efficiently conveyed to the developer storing chamber 101.

[Part 2]

Figure 9:
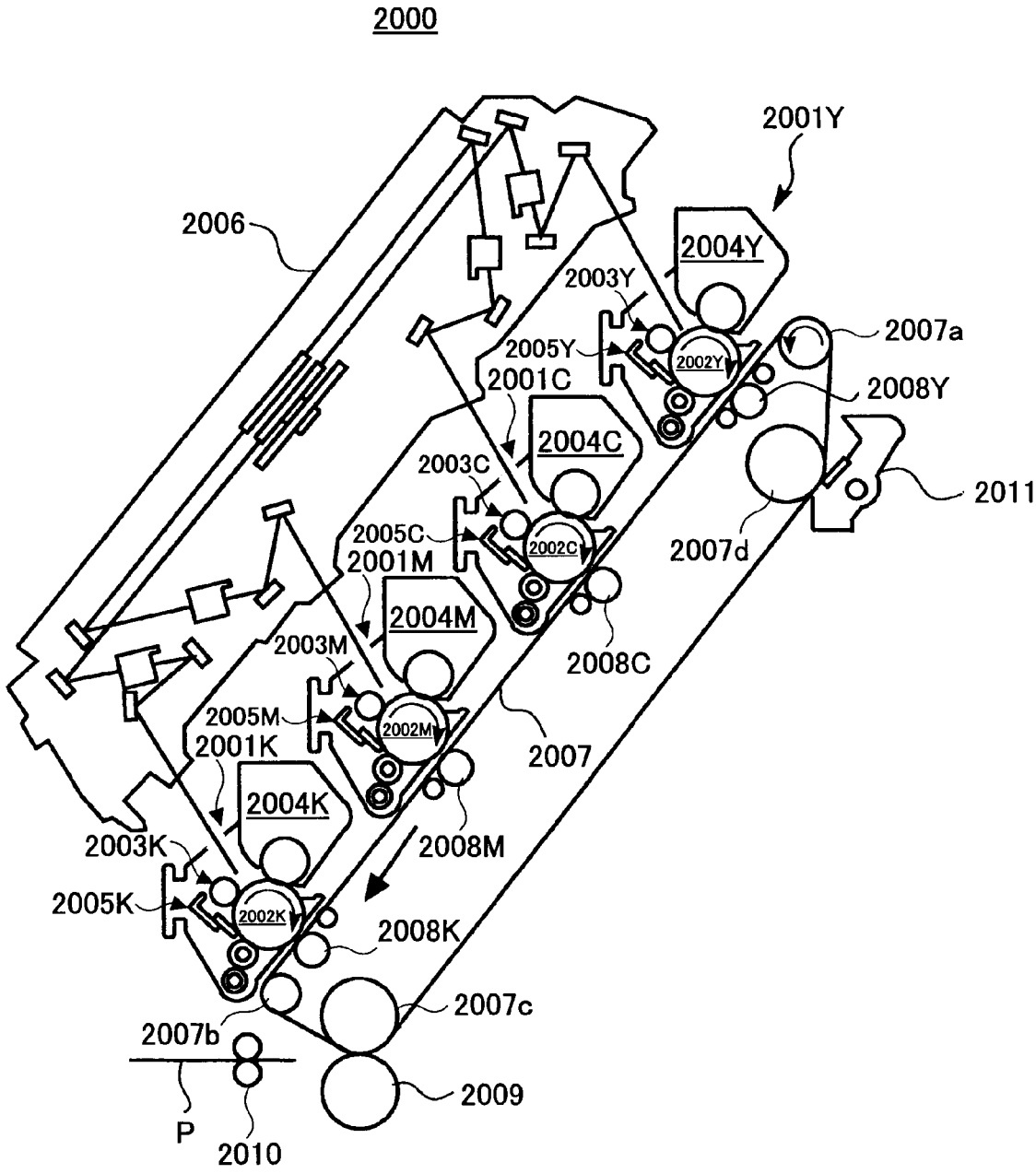
FIG. 9 is a schematic diagram of an image forming apparatus according to an embodiment of the present invention.

FIG. 9 is a schematic diagram showing an image forming apparatus including a developing apparatus and a process cartridge according to another embodiment of the present invention.

The image forming apparatus 2000 has a tandem image forming section in which four toner image forming parts (image forming parts) 2001Y, 2001C, 2001M, and 2001K corresponding to yellow, cyan, magenta, and black are successively diagonally arranged from an upper right side in FIG. 9. In the below-described embodiments of the present invention, the letters "Y", "C", "M", and "K" are indicating the colors yellow, cyan, magenta, and black, respectively. In the tandem image forming section of the image forming apparatus 2000 according to an embodiment of the present invention, each toner image forming part 2001Y, 2001C, 2001M, and 2001K has a charging apparatus including a charging roller (charging part) 2003Y, 2003C, 2003M, 2003K provided at the periphery of a drum-shaped photoconductor 2002Y, 2002C, 2002M, 2002K; a developing apparatus (developing part) 2004Y, 2004C, 2004M, 2004K; and a photoconductor cleaning apparatus 2005Y, 2005C, 2005M, and 2005K.

Furthermore, an optical writing unit (latent image forming part) 2006 is provided above the tandem image forming section. The optical writing unit 2006 includes, for example, an optical source (LED), a polygon mirror, an f-θ lens, and a reflecting mirror. The optical writing unit 2006 irradiates and scans the surface of each photoconductor (photoconductor drum) 2002 based on image data.

Furthermore, the image forming apparatus 2000 also includes an endless intermediary transfer belt (intermediary transfer member) 2007 provided along the diagonally arranged tandem image forming section. The intermediary transfer belt 2007 is wound around supporting rollers 2007*a*, 2007*b*, 2007*c*, and 2007*d*. Among the aforementioned supporting rollers, the supporting roller (driving roller) 2007*a* has a driving motor (not shown) provided at its rotary axle for serving as a driving source. By driving the driving motor, the intermediary transfer belt 2007 rotates in a counter-clockwise direction along with rotating its sub-ordinate driven rollers 2007*b*, 2007*c*, and 2007*d*. First transferring apparatuses including first transfer rollers 2008Y, 2008C, 2008M, and 2008K are provided at an inner side of the intermediary transfer belt 2007 for transferring the toner images formed on the photoconductors 2002Y, 2002C, 2002M, and 2002K to the intermediary transfer belt 2007.

Furthermore, a second transfer apparatus including a second transfer roller 2009 is provided at a position more downstream than the first transfer rollers 2008Y, 2008C, 2008M, 2008K relative to the rotating direction of the intermediary transfer belt 2007. The supporting roller 2007*c*, serving as a pressing member, is oppositely positioned from the second transfer roller 2009 having the intermediary transfer belt 2007 interposed therebetween. Furthermore, the image forming apparatus 2000 includes a sheet-feed cassette (not shown) for storing transfer paper P. Furthermore, the image forming apparatus 2000 also includes a fixing member (not shown) provided more downstream than the second transfer roller 2009 relative to the advancing direction of the transfer paper P for fixing an image onto the transfer paper P.

In each toner image forming part 2001Y, 2001C, 2001M, and 2001K, a corresponding photoconductor 2002Y, 2002C, 2002M, 2002K is rotated in an arrow direction (see FIG. 9) at a peripheral linear speed of 150 mm/sec. Then, the charging rollers 2003Y, 2003C, 2003M, 2003K uniformly (evenly) charge the surfaces of the corresponding photoconductors 2002Y, 2002C, 2002M, 2002K with a voltage of 500 V. Then, the optical writing unit 2006 writes image data onto the photoconductors 2002Y, 2002C, 2002M, and 2002K by irradiating laser beams to the photoconductors 2002Y, 2002C, 2002M, and 2002K. Thereby, electrostatic latent images are formed on the photoconductors 2002Y, 2002C, 2002M, and 2002K.

Then, the developing apparatuses 2004Y, 2004C, 2004M, 2004K adhere toner onto the photoconductors 2002Y, 2002C, 2002M, and 2002K, to thereby form the electrostatic latent images on the photoconductors 2002Y, 2002C, 2002M, and 2002K into visible single color images of yellow, cyan, magenta, and black. Furthermore, the driving motor (not shown) is driven for rotating the driving roller 2007*a* and its sub-ordinate supporting rollers 2007*b*, 2007*c*, and 2007*d*. Thereby, the intermediary transfer belt 2007 is rotated. Then, as the intermediary transfer belt 2007 is rotated, a predetermined first transfer bias is supplied to the first transfer rollers 2008Y, 2008C, 2008M, 2008K from a high voltage power source (not shown), to thereby successively transfer the visible color images onto the intermediary transfer belt 2007. Accordingly, a composite color image is formed on the intermediary transfer belt 2007. After the images are transferred, the surfaces of the photoconductors 2002Y, 2002C, 2002M, and 2002K are cleaned by photoconductor cleaning apparatuses (cleaning parts) 2005Y, 2005C, 2005M, and 2005K, respectively for removing residual toner from the surfaces and preparing for the next image forming operation.

Furthermore, along with the timing of forming the images, the transfer sheet P is fed from the sheet feeding cassette (not shown) and conveyed to a resist roller 2010. Upon reaching the resist roller 2010, the conveyance of the transfer sheet P is temporarily stopped. Then, the transfer sheet P is conveyed between the second transfer roller 2009 and the intermediary transfer belt 2007 at a suitable timing with respect to the above-described image forming operation. In this example, the second transfer roller 2009 and the intermediary transfer belt 2007 form a so-called second transfer nip for nipping the transfer sheet P. By applying a predetermined second transfer bias to the second transfer roller 2009 from a high voltage electric source (not shown), the toner image on the intermediary transfer belt 2007 is transferred onto the transfer sheet P (second transfer).

After the image is transferred to the transfer sheet P, the transfer sheet P is conveyed to the fixing apparatus (not shown). The fixing apparatus applies heat and pressure to the transfer sheet P, to thereby fix the transferred image onto the transfer sheet P. Then, the transfer sheet P is conveyed out of the image forming apparatus 2000. Meanwhile, after the image is transferred from the intermediary transfer belt 2007, an intermediary cleaning apparatus 2011 removes residual toner remaining on the intermediary transfer belt 2007 so as to prepare for the next image forming operation by the tandem image forming section.

It is to be noted that the toner image forming parts 2001Y, 2001C, 2001M, 2001K integrally form a united body to serve as process cartridges that are detachably attached to the body of the image forming apparatus 2000. The process cartridges can be pulled out by releasing corresponding stoppers (not shown). The process cartridge can be replaced by pulling out the process cartridge toward the front of the image forming apparatus 2000 along a guide rail (not shown) fixed to the body of the image forming apparatus 2000. Furthermore, the toner image forming parts 2001Y, 2001C, 2001M, 2001K can be mounted at a predetermined position by inserting the process cartridge into the body of the image forming apparatus 2000.

Next, a developing apparatus included in the image forming apparatus according to an embodiment of the present invention is described with reference to FIGS. 10 and 11.

Figure 10:
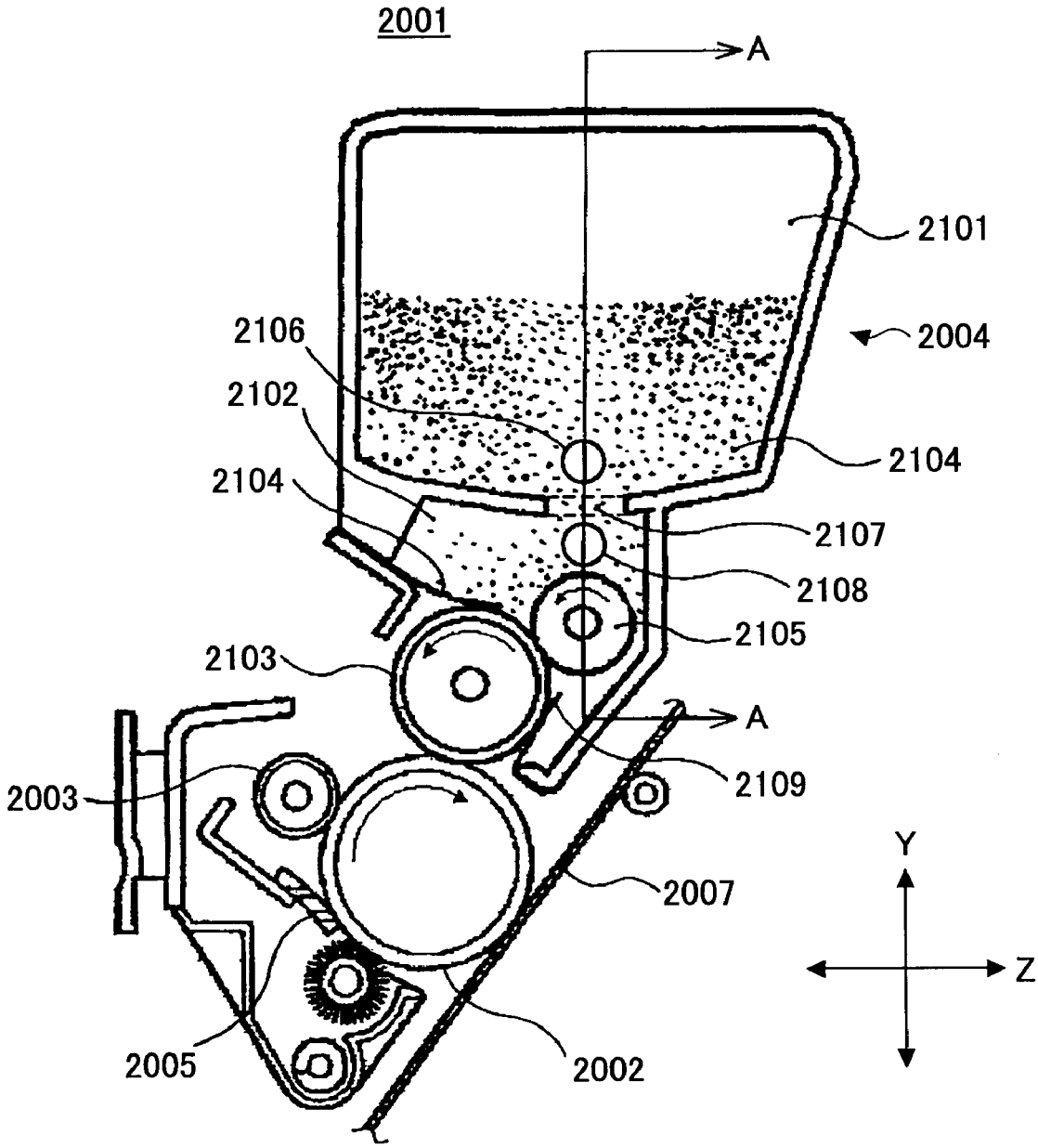
FIG. 10 is an enlarged view of a process cartridge in the image forming apparatus shown in FIG. 9.

FIG. 10 is a schematic diagram showing a process cartridge 2001 of a toner image forming part. The process cartridges corresponding to the toner image forming parts 2001Y, 2001C, 2001M, 2001K have substantially the same configuration and function. Therefore, the letters "Y", "C", "M", and "K" for indicating yellow, cyan, magenta, and black are omitted for the sake of convenience.

The developing apparatus 2004 according to an embodiment of the present invention uses a single component contact developing method. The developing apparatus 2004 uses a nonmagnetic single component toner as a developer for developing an image by a developing roller 2103 contacting the photoconductor 2002.

The developing apparatus 2004 includes a hopper part (secondary storing chamber) 2101 which is longer than wide for storing the nonmagnetic single component toner therein. The developing apparatus 2004 also includes a supplying part (primary storing chamber) 2102 situated below the hopper part 2101. The hopper part 2101 includes an agitating/conveying member 2106 which is rotated by a driving part (not shown) and contains toner to be supplied into the supplying part 2102.

The hopper part 2101 and the supplying part 2102 are in communication via a supplying port 2107. The toner inside the hopper part 2101 is conveyed to the supplying port 2107 by the agitating/conveying member 2106. The toner being conveyed to the supplying port 2107 falls into the supplying part 2102. Thereby, toner is supplied from the hopper part 2101 to the supplying part 2102.

The supplying part 2102 includes a supplying roller (developer supplying member) 2105 and a toner conveying member 2108. The toner conveying member 2108 is rotated by a driving part (not shown). Furthermore, the supplying roller 2105 is also rotated in a counter-clockwise direction by a driving part (not shown).

The developing roller (developer carrier) 2103 is provided below the supplying roller 2105. The developing roller 2103 is rotated in a counter-clockwise direction by a driving part (not shown) while contacting the supplying roller 2105 and the photoconductor 2002.

A developing bias is applied to the developing roller 2103 by a power circuit (not shown). Meanwhile, a supplying bias is applied to the supplying roller 2105 by a power circuit (not shown). The developing bias and the supplying bias have a relationship for forming an electric field that causes electrostatic migration where the negative charge toner migrates from the supplying roller 2105 toward the direction of the developing roller 2103. However, the electric field is not limited to this direction. Depending on the type of toner, the migrating direction may be opposite. Alternatively, no electrostatic migration (0 direction) may occur between the rollers.

The toner falling into the supplying part 2102 from the hopper part 2101 is conveyed in an axial direction by the toner conveying member 2108 and received (captured) by the supplying roller 2105. Along with the rotation of the supplying roller 2105, the toner is conveyed to a contacting part between the supplying roller 2105 and the developing roller 2103. By the aforementioned application of electric field and the pressure between the contacting part, the toner on the supplying roller 2105 is transferred to the surface of the developing roller 2103. In accordance with the rotation of the developing roller, the transferred toner, being carried on the surface of the developing roller 2103, is conveyed and passed through a contacting part between the developing roller 2103 and a thinning blade 2104 (i.e. blade for making the toner on the developing roller 2103 into a thin layer.

An auxiliary charge bias is applied to the thinning blade 2104 from a power circuit (not shown). The auxiliary charge bias and the developing bias have a relationship for forming an electric field that causes electrostatic migration where the negative charge toner migrates from the thinning blade 2104 to the direction of the developing roller 2103. The toner conveyed between the contacting part between the developing roller 2103 and the thinning blade 2104 is pressed towards the developing roller 103 by the electric field while causing frictional electrification with the thinning blade 2103 along with the rotation of the developing roller 2103. At the same time, the thickness of the layer of toner on the developing roller 2103 can be controlled. It is to be noted that the auxiliary charging bias may be direct voltage or direct voltage superimposed with alternating current.

The toner having passed through the contacting part between the thinning blade 2103 and the developing roller 2103 is conveyed to a contacting part between the developing roller 2103 and the photoconductor 2002 by the rotation of the developing roller 2103. The electric potential of the electrostatic latent image on the photoconductor 2002, the electric potential (uniformly charged potential) of the surface part of the photoconductor 2002, and the developing bias have a relationship of forming an electric field that causes electrostatic migration so that the toner situated between the electrostatic latent image and the developing roller 2103 (development nip part) to migrate from the developing roller 2103 to the direction of the electrostatic latent image while the toner situated between the surface part and the developing roller 2103 migrates from the surface part to the direction of the developing roller 2103. Owing to this relationship, at the development nip part, the toner on the surface of the developing roller 2103 is selectively transferred to the electrostatic latent image on the photoconductor 2002.

The surface of the supplying roller 105 is covered by a cellular material having a porous (cellular) configuration and an electrical resistance of $10^3$ to $10^{14}$ Ω·cm. By taking (capturing) the toner into its pores, the toner can be conveyed with greater efficiency. In addition, the pores of the supplying roller 2105 serve to prevent degradation of toner due to concentrated pressure applied to the toner at the contacting part with the developing roller 2103.

The surface layer of the developing roller 2103 is an elastic rubber layer having frictional charging property that is opposite to the polarity of the toner. The surface layer of the developing roller 2103 has a degree of hardness that is no greater than 50 degrees (JIS-A). Furthermore, the surface layer of the developing roller 2103 has a surface roughness of 0.2 to 2.0 μm (Ra). Owing to these characteristics of the surface layer of the developing roller 2103, a toner image can be formed with an even (uniform) thickness on the surface of the developing roller 2103.

The thinning blade 2104, which uses a metal (e.g., SUS304CSP, SUS301CSP, phosphor bronze) planar spring material, has one end contacting and applying pressure of 10-100 [N/M] to the surface of the developing roller 103.

The casing of the supplying part 2102 cantilevers (one end support) a sealing film 2109. The free end of the sealing film 2109 contacts the developing roller 2103. The sealing film 2109 and the thinning blade 2104 serve to partition the space where the developing roller 2103 is installed and the supplying part 2102, so that toner can be prevented from leaking from the supplying part 2102.

Figure 11:
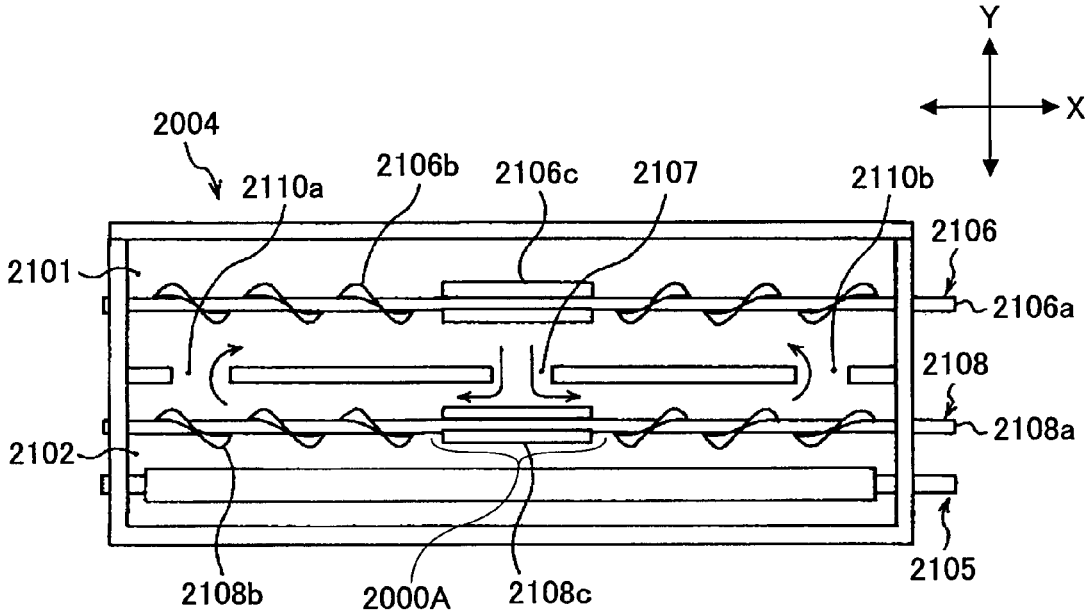
FIG. 11 is a cross-sectional view of a developing apparatus according to an embodiment of the present invention.

FIG. 11 is a cross-sectional diagram of the developing apparatus 2004 taken along line A-A of FIG. 10.

As shown in FIG. 11, the supplying port 2107 is provided at the center of the diagram between the hopper part 2101 and the supplying part 2102. The supplying port 2107 is for supplying toner from the hopper part 2101 to the supplying part 2102. A returning port 2110 (2110*a*, 2110*b*) for returning toner from the supplying part 2102 to the hopper part 2101 is provided on both sides of the hopper part 2101 and the supplying part 2102. The agitating/conveying member 2106 has a rotational axis (rotating shaft) 2106*a* extending substantially parallel to the supplying roller 2105, a spiral wing part 2106*b* formed around the rotational axis (rotating shaft) 2106*a*, and an agitating part 2106*c* formed at a part of the rotational axis (rotating shaft) 2106*a* facing the supplying port 2107. The agitating part 2106*c* has a planar shape which is wider than the width of the supplying port 2107 in the axial direction (X direction).

The supplying part 2102 includes a toner conveying member 2108. The toner conveying member 2108 includes a rotational axis (rotating shaft) 2108*a* extending substantially parallel to the supplying roller 2105, a spiral wing part 2108*b* formed around the rotational axis (rotating shaft) 2108*a*, and an agitating part 2108*c* formed at a part of the rotational axis (rotating shaft) 2108*a* facing the supplying port 2107. The agitating part 2108*c* has a planar shape which is wider than the width of the supplying port 2108 in the axial direction (X direction).

By rotating the agitating/conveying member 2106, the toner in the hopper part 2101 is guided to the wing part 2106*b*, conveyed toward, for example, the center part of the developing apparatus 2004 (center of FIG. 3), and falls from the supplying port 2107 to the supplying part 2102. Then, after the toner enters the supplying part 2102, the toner is guided to the wing part 2108*b* and conveyed from the center part of the developing apparatus 2004 (center of FIG. 3) to both sides of the developing apparatus 2004 in the axial direction (X direction) by rotating the toner conveying member 2108. As the toner is conveyed in the axial direction by the toner conveying member 2108, at least a portion of the toner is captured by the supplying roller 2105. The toner which is not captured by the supplying roller 2105 is conveyed to the returning ports 2110*a*, 2110*b* provided on both sides in the axial direction (X direction). The toner conveyed to the returning ports 2110*a*, 2110*b* is delivered into the hopper part 2101 from the returning ports 2110*a*, 2110*b* by jetting pressure. Then, the returned toner is conveyed again by the agitating/conveying member 2106 to the center part of the developing apparatus 2004. Accordingly, in the developing apparatus 2004, the toner is circulated in the hopper part 2101 and the supplying part 2102 by the agitating/conveying member 2106 in the hopper part 2101 and the toner conveying member 2108 in the supplying part 2102.

In the developing apparatus 2004, no spiral wing part serving to convey toner in the axial direction (X direction) is formed at the part facing the supplying port 2107 (supplying port facing part 2000A). This configuration allows the amount of toner conveyed in the axial direction by the supplying port facing part of the toner conveying member 2108 to be less than the amount of toner conveyed in the axial direction by the other parts of the toner conveying member 2108. Accordingly, the toner directly below the supplying port 2107 can be prevented from being excessively conveyed in the axial direction by the toner conveying member 2108 so that a space can be prevented from being created between the supplying port 2107 and the toner conveying member 2108. Accordingly, the toner inside the hopper part 2101 can be prevented from being excessively supplied to the supplying part 2102. Thus, overfilling of the supplying part 2102 can be prevented. As a result, problems such as aggregation of the toner in the supplying part 2102, increase of the torque of the supplying roller 2103, and uneven density of the toner image can be prevented.

Furthermore, since no or very little toner is conveyed in the axial direction by the supplying port facing part 2000A, it may seem that toner easily aggregates in the supplying part 2102 at the area directly below the supplying port 2107. However, in the configuration of the conveying member 2108, the agitating part 2108*c* is provided directly below the supplying port 2107 for agitating the toner in the area directly below the supplying port 2107. Accordingly, the toner at the area directly below the supplying port 2107 can be prevented from aggregating.

Although since the spiral wing parts 2108*b* provided adjacent to the agitating part 108*c* convey toner in the axial direction, a space (gap) is created at the area of the spiral wing parts 2108*b*. Therefore, in a case where the length of the agitating part 108*c* in the axial direction (X direction) is shorter than the width of the supplying port 2107 in the axial direction (X direction), the toner falling from at least from the rim part of the supplying port 2107 will enter the space (gap) and accumulate in the space (gap). This could lead to overfilling of toner in the supplying part 2102. However, owing to the configuration of the toner conveying member 2108 where the length of the agitating part 2108*c* in the axial direction is longer than the width of the supplying port 2107 in the axial direction (i.e. extending the agitating part 2108*c* to an area not facing the supplying port 2107), the agitating part 2108*c* captures the toner falling from the rim part of the supplying port 2107 and advancing towards the space (gap) of the spiral wing parts 2108*b* situated adjacent to the agitating part 2108*c*. As a result, the agitating part 2108*c* agitates the toner falling from the supplying port 2107, so that the toner can be maintained in the area directly below the supplying port 2107 (i.e. prevents the toner from flowing to the space (gap) of the spiral wing parts 2108*b*). This further prevents overfilling of toner in the supplying part 2102.

In addition to the function of conveying toner in the axial direction, the toner conveying member 2108 according to the above-described embodiment of the present invention has a function of agitating the toner provided between the toner conveying member 2108 and the supplying port 2107 by providing the agitating part 2108*c* at a center part of the rotational axis 2108*a* facing the supplying port 2107. However, the developing apparatus 2004 including the toner conveying member 2108 is not limited to such configuration. Next, other embodiments of the present invention are explained with the below-described modified examples 1-5.

Modified Example 1

Figure 12:
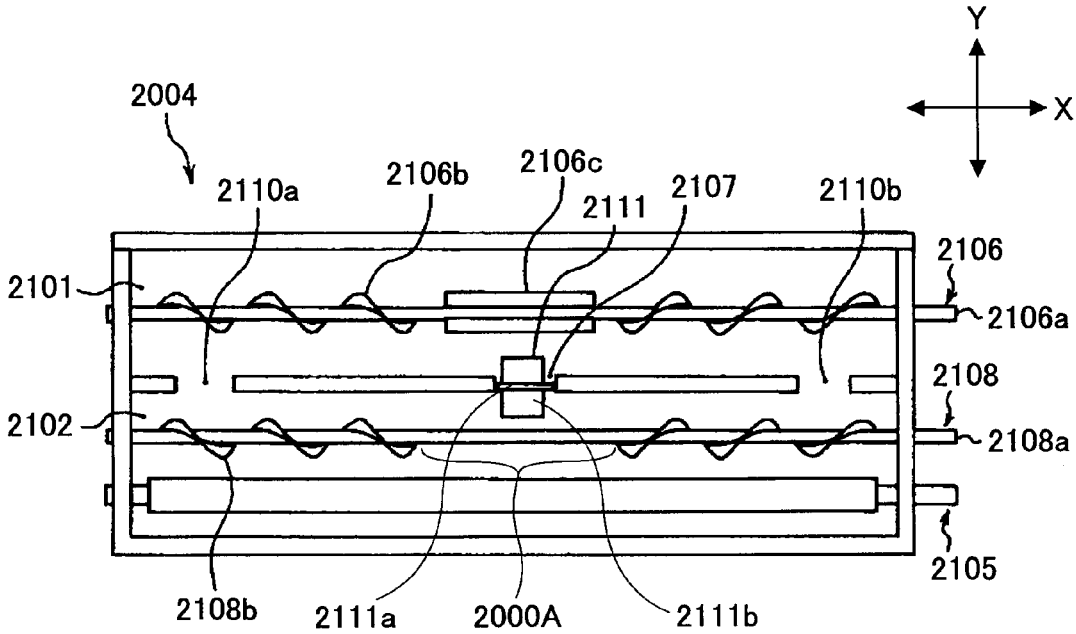
FIG. 12 is a cross-sectional view of a first modified example of the developing apparatus according to an embodiment of the present invention.

FIG. 12 is a cross-sectional diagram of a developing apparatus 2004 according to another embodiment of the present invention.

In the developing apparatus 2004 of modified example 1 shown in FIG. 12, an agitating member 2111 is provided separately with the toner conveying member 2108. The toner conveying member 2108 has no spiral wing part 2108*b* provided at the part facing the supplying port 2107 so as to prevent toner from being conveyed in the axial direction at the area facing the supplying port 2107. This prevents a space (gap) from being created between the supplying port 2107 and the toner conveying member 2108. Thus, the toner in the hopper part 2101 can be prevented from being excessively supplied to the supplying part 2102.

Furthermore, the agitating member 2111 is provided at the supplying port 2107. The agitating member 2111 has a planar agitating part 2111*b* mounted to a rotating shaft 2111*a*. By rotating the agitating member 2111, the toner between the toner conveying member 2108 and the supplying port 2107 is agitated for preventing aggregation of toner.

Modified Example 2

Figure 13:
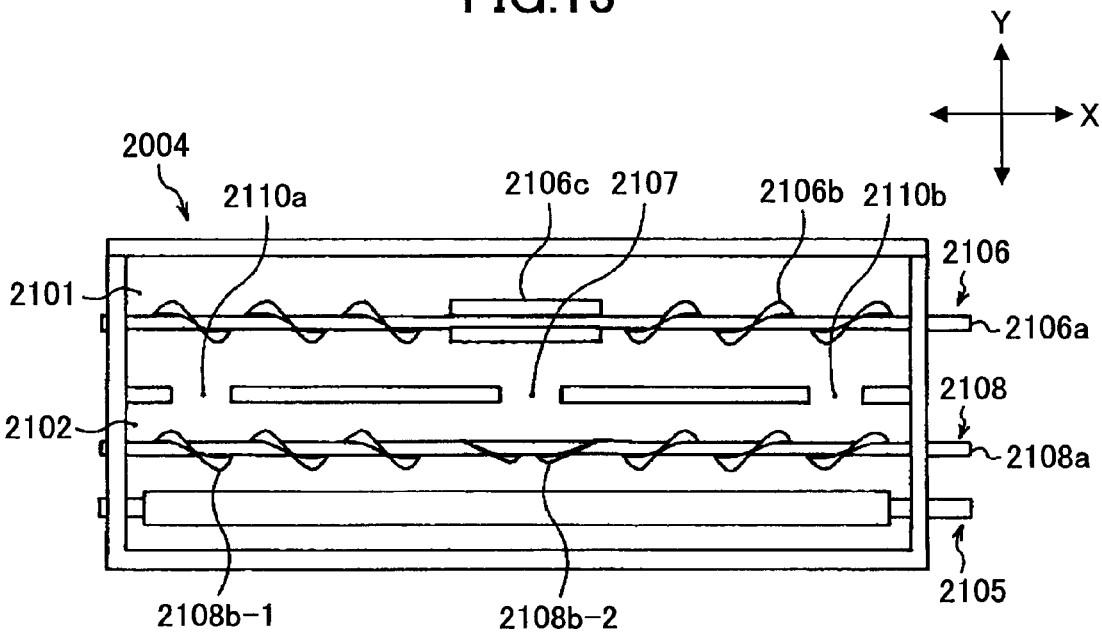
FIG. 13 is a cross-sectional view of a second modified example of the developing apparatus according to an embodiment of the present invention.

FIG. 13 is a cross-sectional diagram of a developing apparatus 2004 according to another embodiment of the present invention.

In the developing apparatus 2004 of modified example 2 shown in FIG. 13, the toner conveying member 2108 has a first spiral wing part(s) 2108*b*-2 provided at a part facing the supplying port 2107 and a second spiral wing part(s) 2108*b*-1 provided at a part(s) other than the part facing the supplying port 2107. The first spiral wing part 2108*b*-2 has less height (e.g., length between the rotational axis 2108*a* and the tip of the first spiral wing part 2108*b*-2 in the Y direction) than the height (e.g., length between the rotational axis 2108*a* and the tip of the second spiral wing part in the Y direction) of the second wing part 2108*b*-1 with respect to the axial direction (X direction). Accordingly, the amount of toner conveyed in the axial direction at the area directly below the supplying port 2107 can be less than the amount of toner conveyed in the axial direction at the areas other than the area directly below the supplying port 2107. This configuration can also prevent a space (gap) from being created between the supplying port 2107 and the toner conveying member 2108. Thus, the toner in the hopper part 2101 can be prevented from being excessively supplied to the supplying part 2102.

Modified Example 3

Figure 14:
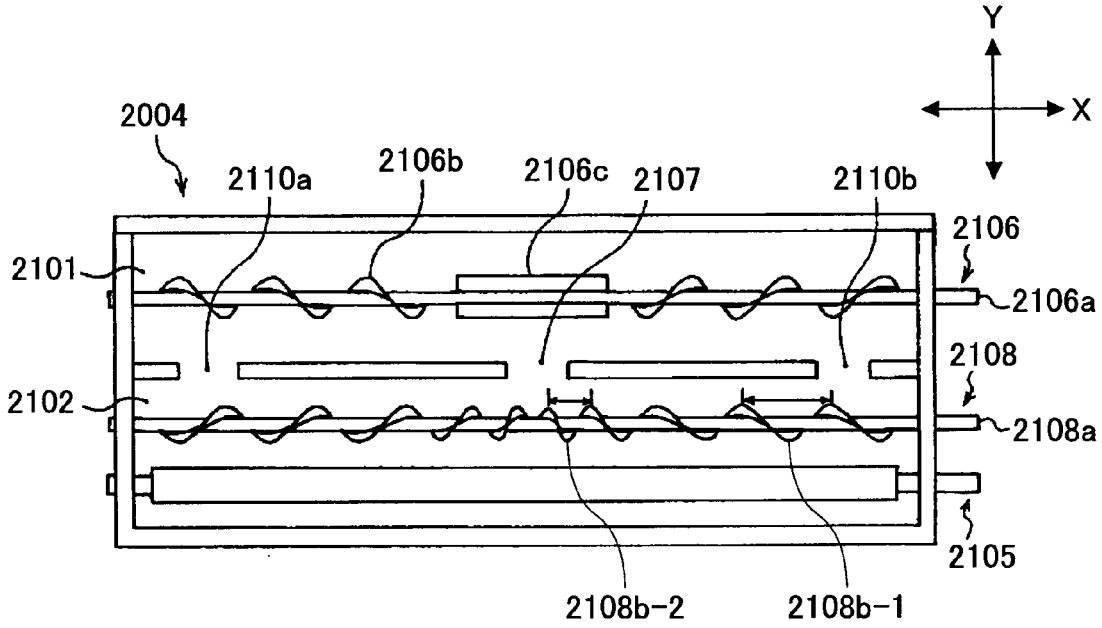
FIG. 14 is a cross-sectional view of a third modified example of the developing apparatus according to an embodiment of the present invention.

FIG. 14 is a cross-sectional diagram of a developing apparatus 2004 according to another embodiment of the present invention.

In the developing apparatus 2004 of modified example 3 shown in FIG. 14, the toner conveying member 2108 in this embodiment has first spiral wing parts 2108*b*-2 provided at a part facing the supplying port 2107 and second spiral wing parts 2108*b*-1 provided at a part(s) other than the part facing the supplying port 2107. The first spiral wing parts 2108*b*-2 are arranged with a smaller pitch P1 (e.g., interval between the first spiral wing parts 2108*b*-2 in the X direction) than the pitch P2 (e.g., interval between the second spiral wing parts in the X direction). Accordingly, the amount of toner conveyed in the axial direction by the first spiral wing parts 2108*b*-2 at the area directly below the supplying port 2107 can be less than the amount of toner conveyed in the axial direction by the second spiral wing parts 2108*b*-1 at the areas other than the area directly below the supplying port 2107. This configuration can also prevent a space (gap) from being created between the supplying port 2107 and the toner conveying member 2108. Thus, the toner in the hopper part 2101 can be prevented from being excessively supplied to the supplying part 2102.

Figure 15:
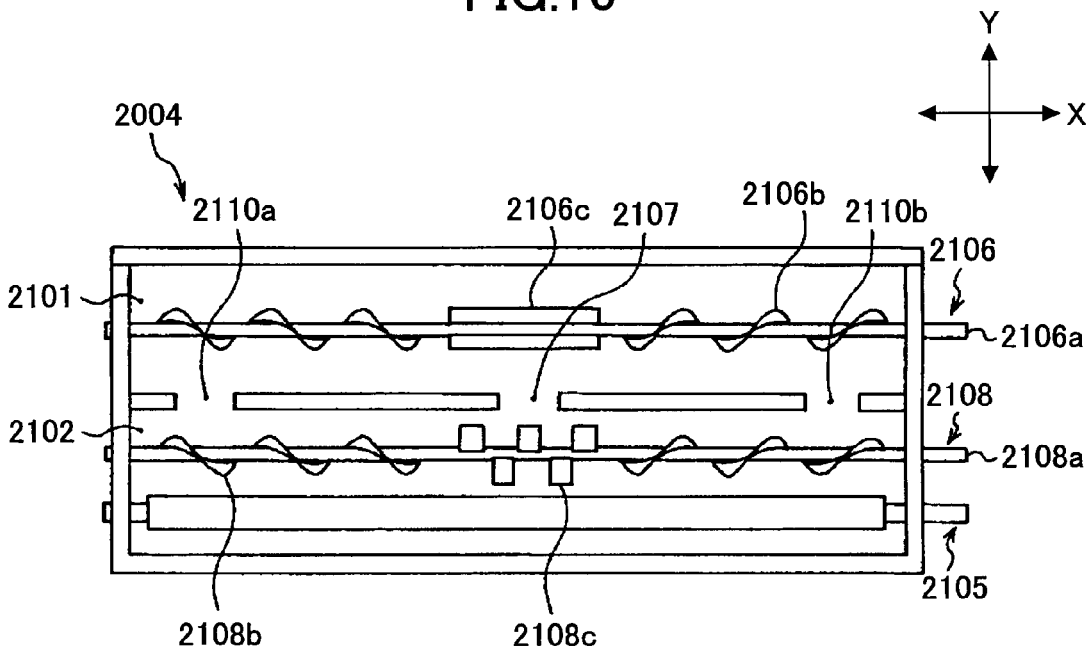
FIG. 15 is a cross-sectional view of a fourth modified example of the developing apparatus according to an embodiment of the present invention.

FIG. 15 is a cross-sectional diagram of a developing apparatus 2004 according to another embodiment of the present invention.

In the developing apparatus 2004 of modified example 4 shown in FIG. 15, plural agitating parts 2108*c* are provided in the toner conveying member 2108 in its peripheral direction at the part facing the supplying port 2107. The length (outer diameter) of the agitating parts 2108*c* in a peripheral direction is greater than the length of the supplying port 2107 in a direction (e.g., Y direction or Z direction) perpendicular to the axial direction (X direction). In this example, each agitating part 2108*c* has a length substantially equivalent to a half-rotation of the rotating axis 2108*a*. Furthermore, in this example, the phase of adjacent agitating parts 2108*c* is aligned a half-rotation apart from each other. By extending the length of the agitating part 2108*c* in the peripheral direction, at least a part of the toner advancing toward the space (gap) of the spiral wing parts 2108*b* adjacent to the agitating parts 2108*c* can be blocked off by the agitating parts 2108*c*. As a result, the toner can be maintained in the area directly below the supplying port 2107 (i.e. prevents the toner from flowing to the space (gap) of the spiral wing parts 2108*b*). This further prevents overfilling of toner in the supplying part 2102.

Modified Example 5

Figure 16:
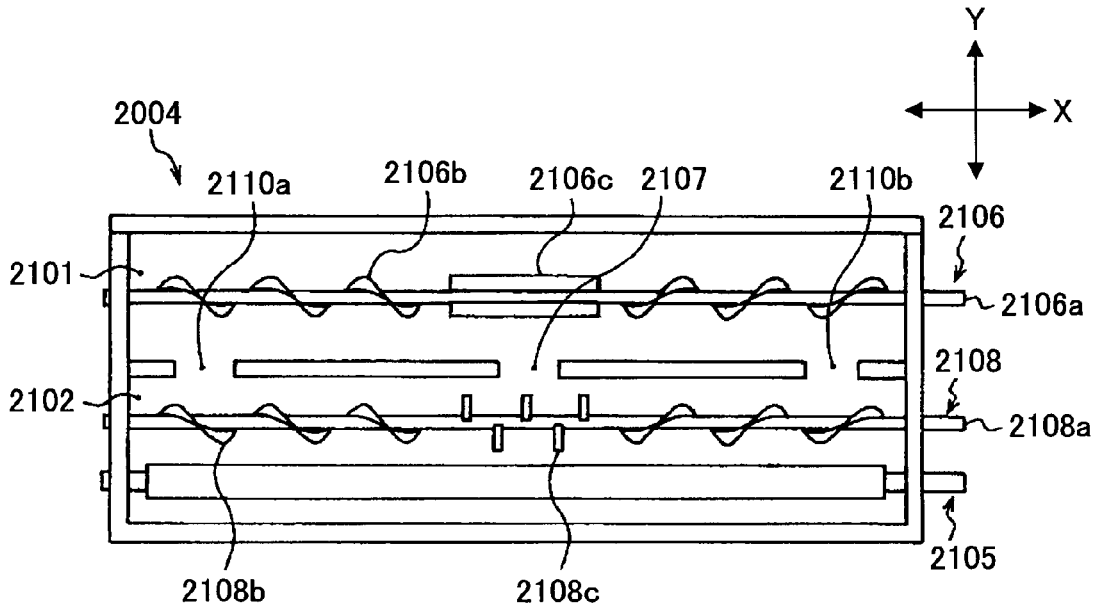
FIG. 16 is a cross-sectional view of a fifth modified example of the developing apparatus according to an embodiment of the present invention.

FIG. 16 is a cross-sectional diagram of a developing apparatus 2004 according to another embodiment of the present invention.

In the developing apparatus 2004 of modified example 5 shown in FIG. 16, plural agitating parts 2108*c* having stick-like protruding shapes are provided at the part of the toner conveying member 2108 facing the facing the supplying port 2107. Accordingly, in this embodiment of the present invention, these stick-like protrusions agitate the toner at the area directly below the supplying port 2107. This configuration can also prevent toner from aggregating at the area directly below the supplying port 2107.

Although the above-described image forming apparatus is described having plural process cartridges (process units) for forming multi-color toner images, the above-described embodiments of the present invention may be applied to an image forming apparatus which only has a single photoconductor.

According to the above-described embodiment of the present invention, since the hopper part (second storing chamber) 2101 can be provided above the supplying part (first storing chamber) 2102, the developing apparatus can have a configuration which is longer than is wide and use the tandem type image forming method without having to increase its size. Furthermore, since the toner conveying member 2108 conveys the toner from the supplying port 2107 in the axial direction, toner can be evenly applied to the surface of the supplying roller 2105 in the axial direction. Since toner is conveyed by the toner conveying member 2108, the toner can be agitated, to thereby prevent toner from aggregating in the supplying part 2102. Furthermore, since a part of the toner conveying member 2108 facing the supplying port 2107 conveys a lesser amount of toner than the other parts of the toner conveying member 2108, a lesser amount of toner at the area below the supplying port 2107 will be moved in the axial direction by the rotation of the toner conveying member 2108. As a result, the toner supplied from the supplying port 2107 for filling the space created by the rotation of the toner conveying member 2108 can be reduced. Thus, the supplying part 2102 can be prevented from being overfilled by toner. Accordingly, problems such as increase of torque of the supplying roller 2105, uneven image density, and wear of the developer supplying mechanism due to aggregation of toner can be prevented.

As shown in the modified example 2, since the height of the first spiral wing part 2108*b*-2 provided at the part of the toner conveying member 2108 directly below the supplying port 2107 is less than the height of the second spiral wing part 2108*b*-1 provided at the other parts of the toner conveying member 2108, the amount of toner conveyed by the first spiral wing part 2108*b*-2 at the part directly below the supplying port 2107 can be less than that conveyed by the second spiral wing part 2108*b*-1 provided at the other parts of the toner conveying member 2108.

As shown in the modified example 1, in a case where the toner conveying member 2108 has no spiral wing part provided at the part facing the supplying port 2107, the amount of toner conveyed at the part directly below the supplying port 2107 can be less than that conveyed at the parts other than the part directly below the supplying port 2107.

As shown in the modified example 3, in a case where the pitch P1 of the first spiral wing part 2108*b*-2 provided at the part of the toner conveying member 2108 directly below the supplying port 2107 is less than the pitch P2 of the second spiral wing part 2108*b*-1 provided at the other parts of the toner conveying member 2108, the amount of toner conveyed at the part directly below the supplying port 2107 can be less than that conveyed at the parts other than the part directly below the supplying port 2107.

Furthermore, as shown in modified example 1, by providing the agitating member 2111 between the toner conveying member 2108 and the supplying port 2107, toner can be prevented from aggregating between the toner conveying member 2108 and the supplying port 2107.

Furthermore, as shown in modified example 1, by providing the agitating member 2111 with a configuration including the agitating part 2111*b* provided to the rotating shaft 2111*a*, the toner between the toner conveying member 2108 and the supplying port 2107 can be agitated by simply rotating the rotating shaft 2111*a*.

Furthermore, in the above-described embodiment of the present invention, since the length of the agitating part 2108*c* in the axial direction is greater than the length of the supplying port 2107 in the axial direction, the toner falling from the rim part of the supplying port 2107 and advancing toward the space (gap) of the spiral wing part 2108*b* situated adjacent to the agitating part 2108*c* can be captured by the agitating part 2108*c*. As a result, the agitating part 2108*c* can maintain the toner at the area directly below the supplying port 2107 and further prevent the toner from overfilling the supplying part 2102.

Furthermore, as shown in the modified example 4, since the length (outer diameter) of the agitating parts 2108*c* in a peripheral direction is greater than the length of the supplying port 2107 in a direction (e.g., Y direction or Z direction) perpendicular to the axial direction (X direction), at least a part of the toner advancing toward the space (gap) of the spiral wing parts 2108*b* adjacent to the agitating parts 2108*c* can be blocked off by the agitating parts 2108*c*. As a result, the toner can be maintained in the area directly below the supplying port 2107 (i.e. prevents the toner from flowing to the space (gap) of the spiral wing parts 2108*b*). This further prevents overfilling of toner in the supplying part 2102.

Furthermore, as shown in the modified example 5, the agitating parts 2108*c* are formed as stick-like protrusions for agitating the toner at the area directly below the supplying port 2107.

Furthermore, according to the above-described embodiment of the present invention, by positioning the toner conveying member 2108 directly below the supplying port 2107 and mounting an agitating member to the toner conveying member 2108 for agitating the toner between the toner conveying member 2108 and the supplying port 2107, the number of necessary components can be reduced compared to a case of separately preparing a toner conveying member and an agitating member.

According to the above-described embodiment of the present invention, since a photoconductor 2002 and a developing apparatus 2004 are provided as a single process cartridge 2001 which is detachably attached to an image forming apparatus 2000, the photoconductor 2002 and the developing apparatus 2004 can be easily replaced.

[Part 3]

Figure 17:
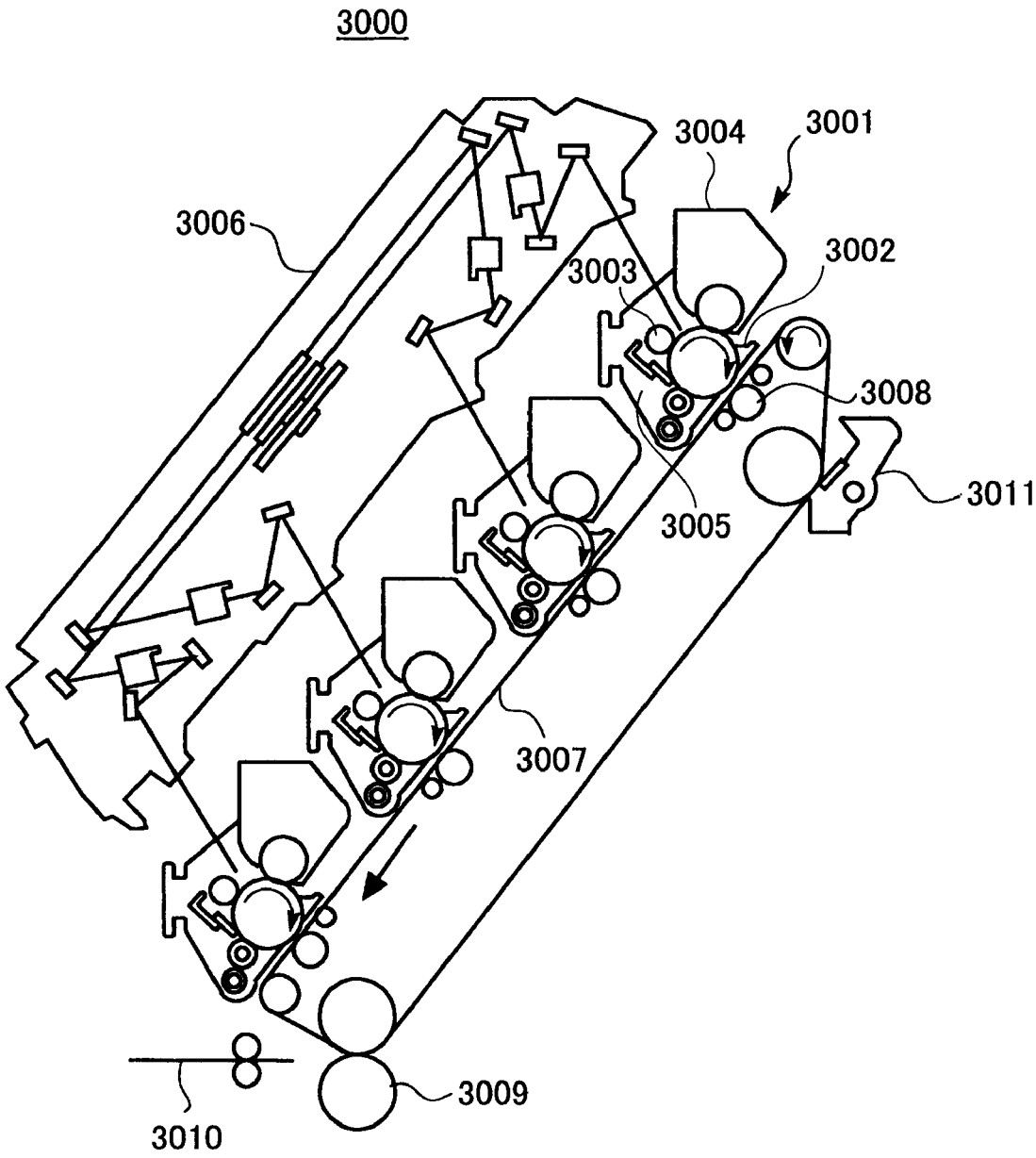
FIG. 17 is a cross-sectional diagram of an image forming apparatus including a developing apparatus and a process cartridge unit according to an embodiment of the present invention.

FIG. 17 is a schematic diagram showing an image forming apparatus including a developing apparatus and a process cartridge (process cartridge unit) according to an embodiment of the present invention. In FIG. 17, a process cartridge unit 3001 has a photoconductor 3002, a charging roller 3002, a developing apparatus 3004, and a cleaning apparatus 3005 that are integrated to form a united body. The process cartridge unit 3001 can be replaced by releasing a corresponding stopper. The image forming apparatus 3000 includes one or more process cartridge units 3001. With this configuration, the image forming apparatus 3000 can form a singe color image or a multi-color image.

The photoconductor 3002 has a cylindrical drum-shape including a photosensitive layer having a photoconductive property. However, the shape of the photoconductor 3002 is not limited to a drum-shape. For example, the photoconductor 3002 may be configured as a belt. The photoconductor 3002 according to an embodiment of the present invention rotates in an arrow direction (see FIG. 17) in a peripheral speed of 150 mm/sec.

The charging roller 3003 is pressed against the surface of the photoconductor 3002. The charging roller 3003 subordinately rotates with respect to the rotation of the photoconductor 3002. A predetermined bias is applied to the charging roller 3003 from a high voltage power source, so that the surface of the photoconductor 3002 can be charged to −500 V.

An exposing part 3006 irradiates light to the photoconductor 3002 for writing image information thereto. Accordingly, a latent image is formed at the areas of the photoconductor 3002 exposed by the light. The exposing part 3006 is, for example, laser beam scanner or an LED using a laser diode.

The developing apparatus 3004 uses a single component contact developing method for forming the latent image on the photoconductor 3002 into a visible toner image. A predetermined developing bias is applied to the photoconductor 3002 from a high voltage power source (not shown). In this example, four process cartridge units 3001 are serially aligned in a conveying direction of an intermediary transfer belt 3007 for successively forming the visible images in the order of yellow, cyan, magenta, and black.

More specifically, the visible toner image on the surface of the each photoconductor 3002 is transferred to the surface of the intermediary transfer belt 3007 by applying a first transfer bias to each corresponding first transfer roller 3008. The intermediary transfer belt 3007 is rotated by a driving motor (not shown), so that the visible toner images transferred to its surface in a superposed manner, to thereby form a full color image. After the toner image on the photoconductor 3002 is transferred to the intermediary transfer belt 3007, the cleaning apparatus 3005 cleans the surface of the photoconductor 3002.

The full color image is transferred to a sheet of paper (transfer sheet) 3010 by applying a predetermined voltage to a second transfer roller 3009. Then, a fixing apparatus (not shown) fixes the transferred image on the paper 3010. Then, the paper 3010 is discharged from the image forming apparatus 3001. The residual toner remaining on the intermediary transfer belt 30007 (toner not transferred by the second transfer roller 9) is removed by a transfer belt cleaning apparatus 3011.

Figure 18:
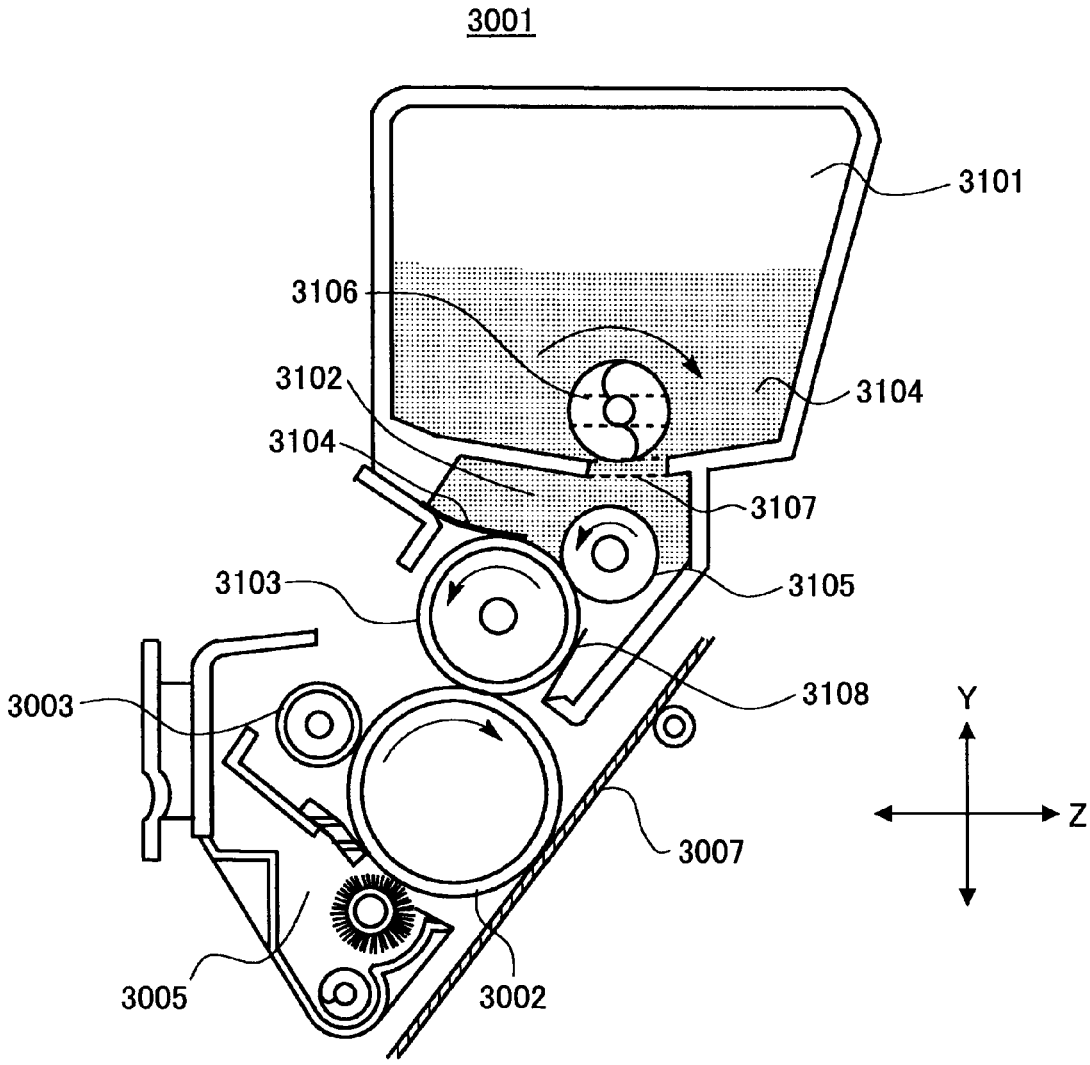
FIG. 18 is a cross-sectional diagram of a process cartridge including a developing apparatus according to an embodiment of the present invention.

FIG. 18 is a cross-sectional view of a process cartridge 3001 including the developing apparatus 3004 according to an embodiment of the present invention. The developing apparatus 4 includes a toner storing chamber 3101 for storing toner and a toner supplying chamber 3102 provided below the toner storing chamber 3101. A developing roller 3103, a layer thickness restricting member 3104 contacting the developing roller 3103, and a supplying roller 3105 are positioned at a lower part of the toner supplying chamber 3102. The developing roller 3103 is provided in a manner contacting the photoconductor 3102. A predetermined developing bias is applied to the developing roller 3103 from a high voltage power source (not shown). Furthermore, a toner conveying member 3106 is provided inside the toner storing chamber 3101. The toner conveying member 3106 is configured to reduce the toner conveying force in a substantially horizontal direction(s) at the vicinity of a supplying port (toner supplying opening part) 3107. The toner conveying member 3106 shown in FIG. 18 is rotated in the arrow direction. The toner conveying member 3106 is configured as a rotating shaft combined with a spiral screw part and a planar part (e.g., flap, wing). The toner conveying member 3106 is preferred to have the spiral screw part for suitably controlling the conveying force and the planar part for providing an agitating force without generating a conveying force. It is particularly preferable to provide the planar part at a part of the toner conveying member 3106 (supplying port facing part) facing the supplying port 2107 and the spiral screw parts at other parts of the toner conveying member 3106 besides the supplying port facing part.

It is, however, to be noted that the toner conveying member 3106 is not limited to the above-described configuration. For example, the toner conveying member 3106 may be a combination of a conveyor belt or a coil for providing the conveying function and a planar shape (e.g., wing, flap) or a paddle formed by bending a wire planar member for providing a raveling (raveling out) function.

Accordingly, owing to the above-described configuration of the toner conveying member 3106, the toner is conveyed in the substantially horizontal direction and raveled out at the vicinity of the supplying port 3107. Thereby, the toner falls through the supplying port 3107 by its own weight and enters the toner supplying chamber 3102.

The surface of the supplying roller 3105 is covered by a cellular material having pores (cells) formed thereto. The cellular porous configuration of the supplying roller 3105 serves to take (capture) the toner carried into the toner supplying chamber 3102 by adhering the toner thereto and also serves to prevent degradation of toner due to pressure concentrating at the contacting area with respect to the developing roller 103. A material having an electrical resistance of $10^3$ to $10^{14}$ Ω·cm is used as the cellular material. An offset voltage, which has the same polarity as the charging polarity of the toner with respect to the developing bias, is applied as a supplying bias to the supplying roller 3105. The supplying bias applied to the supplying roller 3105 works to press the preliminarily charged developer against the developing roller 3103 at the contacting area between the supplying roller 3105 and the developing roller 3103. The polarity of the voltage applied to the supplying roller 3105 is not limited to the aforementioned polarity. For example, depending on the type of developer, the voltage applied to the supplying roller 3105 may have the same potential as the developing roller 3103 or have an inverted polarity with respect to the developing roller 3103. The supplying roller 3105 according to an embodiment of the present invention rotates in a counter-clockwise direction, to thereby allow the toner adhered to its surface to coat (cover) the surface of the developing roller 3103.

The developing roller 3103 may be a roller covered by an elastic rubber layer. The developing roller 3103 may further have the surface of the elastic rubber layer coated by a material having a characteristic of being easily charged to a polarity opposite as the toner. In order to maintain an evenly contacting state with respect to the photoconductor (photoconductor drum) 3002, the elastic rubber layer has a degree of hardness that is no greater than 50 degrees (JIS-A). Furthermore, in order for a developing bias to have effect, a material having an electrical resistance of $10^3$ to $10^{10}$ Ω·cm is used as the material of the developing roller 3103. Furthermore, a material having a surface roughness of 0.2 to 2.0 μm (Ra) is used as the material of the developing roller 3103 so that a necessary amount of toner can be retained (held) on the surface of the developing roller 3103. Such developing roller 3103 according to an embodiment of the present invention rotates in a counter-clockwise direction, to thereby allow the toner retained on its surface to be conveyed through the layer thickness restricting member 3104 and finally to the position facing the photoconductor 3002.

The layer thickness restricting member 3104, which uses a metal (e.g., SUS304CSP, SUS301CSP, phosphor bronze) planar spring material, has one end contacting and applying pressure of 10-100 [N/M] to the surface of the developing roller 3103. As the toner on the developing roller 3103 passes through the layer thickness restricting member 3104, the layer thickness of the toner is reduced and charge is applied to the toner by the frictional electricity generated by the pressure applied by the layer thickness restricting member 3104. In order to supplement the frictional electricity, a voltage offset to the same polarity as the charging polarity of the toner with respect to the potential of the developing roller 3103 is applied as a restriction bias to the layer thickness restricting member 3104.

Since the photoconductor 3002 rotates in the clockwise direction, the surface of the developing roller 3103 advances in the same direction as the photoconductor 3002 at the area where the photoconductor 3002 and the developing roller 3103 face each other. After the layer of the toner on the developing roller 3103 is thinned by the layer thickness restricting member 3104, the rotation of the developing roller 3103 conveys the toner the area where the photoconductor 3002 and the developing roller 3103 face each other. At this area, the toner is transferred to the surface of the photoconductor 3002 according to the latent electric field created by the developing bias applied to the developing roller 3103 and the electrostatic latent image formed on the photoconductor 3002. Thereby, the toner is developed.

A sealing member (seal) 3108 is provided in a manner contacting the developing roller 3103 at a portion where residual toner (toner not developed onto the photoconductor 3002) remaining on the developing roller 3103 returns to the inside of the developer supplying chamber 3102. This sealing member 3108 seals the residual toner, so that the toner does not leak outside of the developing apparatus 3004.

Figure 19:
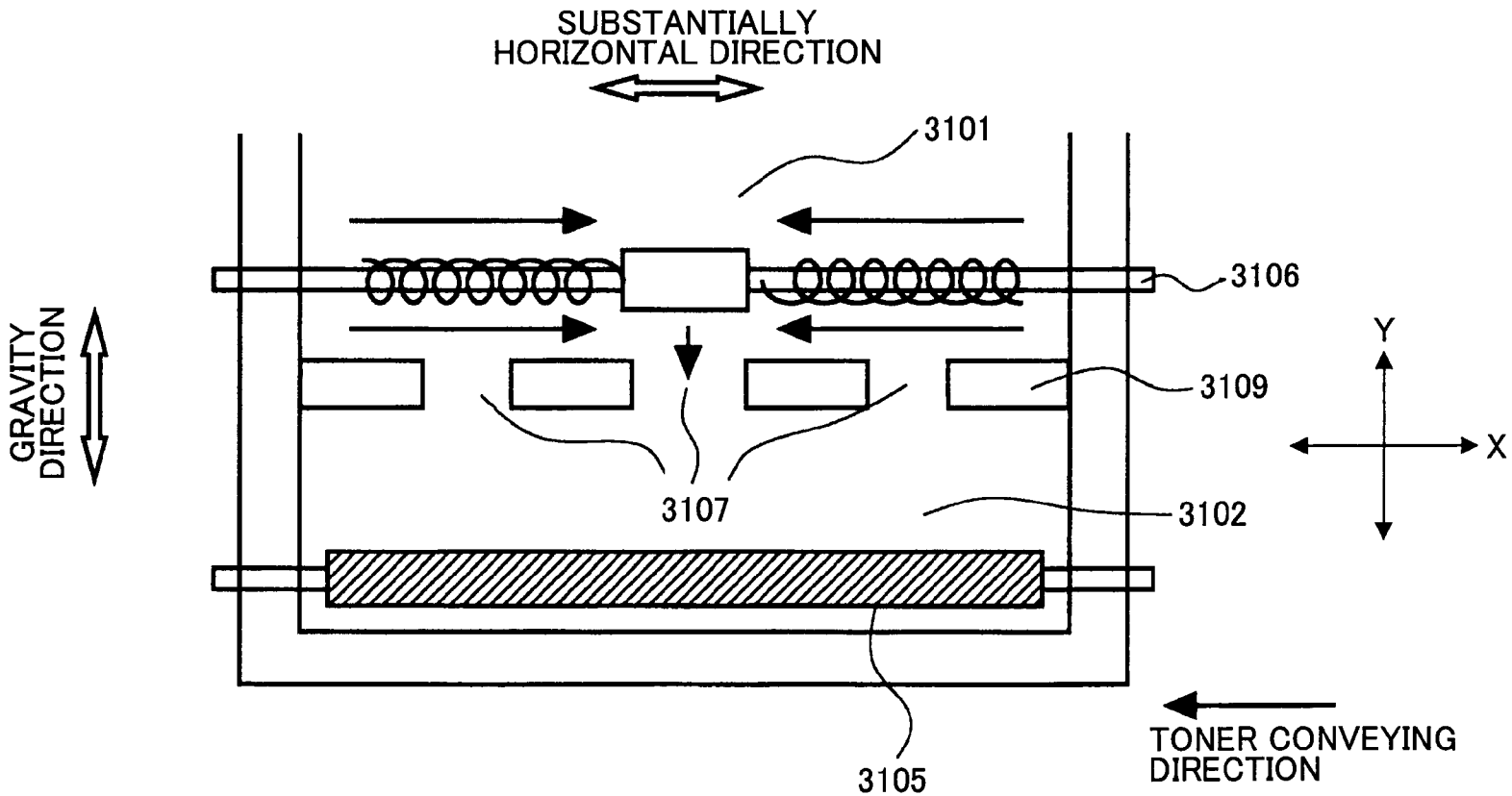
FIG. 19 is a schematic cross-sectional diagram of a developing apparatus according to an embodiment of the present invention when viewed from another direction.

FIG. 19 is a cross-sectional diagram of the developing apparatus 3004 according to an embodiment of the present invention. The supplying roller 3105 is provided at a bottom part of the toner supplying chamber 3102. The toner storing chamber 3101 is position above the toner supplying chamber 3102. A partitioning member 3109 having plural supplying ports (opening parts) 3107 is interposed between the toner supplying chamber 3102 and the toner storing chamber 3101. As toner approaches the vicinity of the supplying port 3107 at the center part of the partitioning member 3109, the movement of the toner in the substantially horizontal direction (X direction) becomes less. Accordingly, the toner is agitated by a toner conveying member (agitating paddle) 3106 above the supplying port 3107 at the center part of the partitioning member 3109. As the amount of toner becomes less in the toner supplying chamber 3102, the toner drawn into the toner supplying chamber 3102 by its own weight (gravity). Although other supplying ports 3107 are provided at other parts of the partitioning member 3109 besides its center part, the toner in the vicinity of the other supplying ports 3107 rarely falls to the toner supplying chamber 3102 by its own weight since the toner is conveyed with a strong conveying force at the vicinity of the other supplying ports 3107. Therefore, as powder pressure in the toner supplying chamber 3102 becomes higher due to the increase in the amount of toner in the toner supplying chamber 3102, the force generated by the powder pressure carries the toner to the toner storing chamber 3101. This mechanism prevents toner from overfilling the toner supplying chamber 3102.

Figure 20:
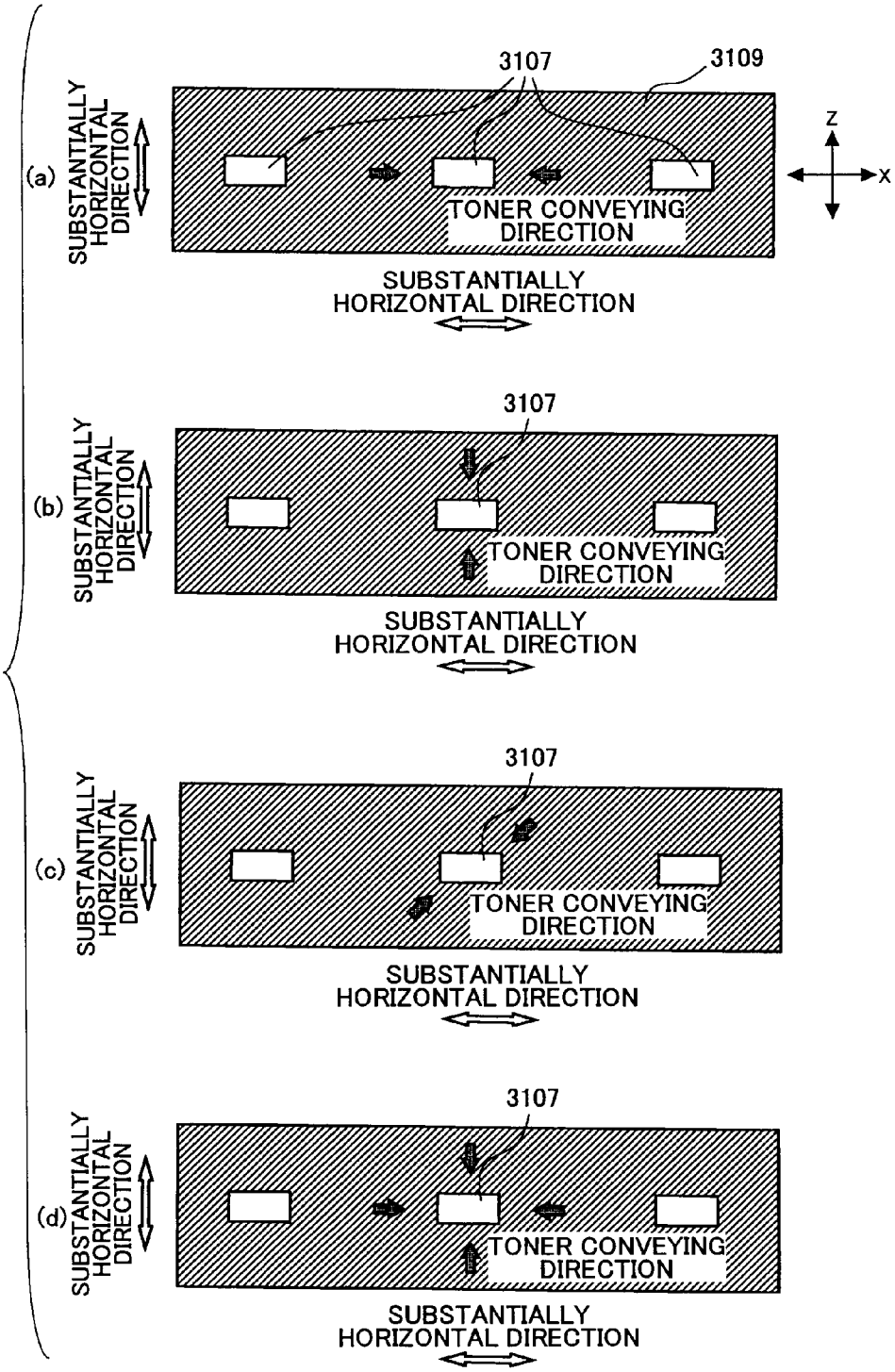
FIG. 20 is a plan view of a toner storing chamber according to an embodiment of the present invention.

FIG. 20 is a plan view of the toner supplying chamber 3102 for describing the conveying direction of toner in the vicinity of the supplying port 3107. In this example, the partitioning member 3109 includes at least one supplying port 3107. The toner conveying member (agitating paddle) 3106 situated in the vicinity of the supplying port 3107 conveys the toner towards the direction of the supplying port 3107. By gathering the toner to the vicinity of the supplying port(s) 3107, a sufficient amount of toner can be acquired in the area above the supplying port 3107(*s*) and prevent shortage of toner in the toner supplying chamber 3102. By gathering the toner in the vicinity of the supplying port(s) 3107, the toner in the toner storing chamber 3101 can be thoroughly used to the end.

In FIG. 20 (*a*), in a case where the toner conveying direction is the X direction, plural supplying ports 3107 are formed at the middle of the partitioning member 3109 in the X direction. With this configuration, the toner conveying member (agitating paddle) 3106 is provided in a manner extending in the X direction (axial direction) for conveying the toner in the X direction and supplying the toner to the supplying ports 3107. In FIG. 20 (*b*), the toner conveying direction is the Z direction (depth direction). In FIG. 20 (*c*), the toner conveying direction is a diagonal direction. In FIG. 20 (*d*), the toner conveying direction is both the X direction and the Z direction.

Figure 21:
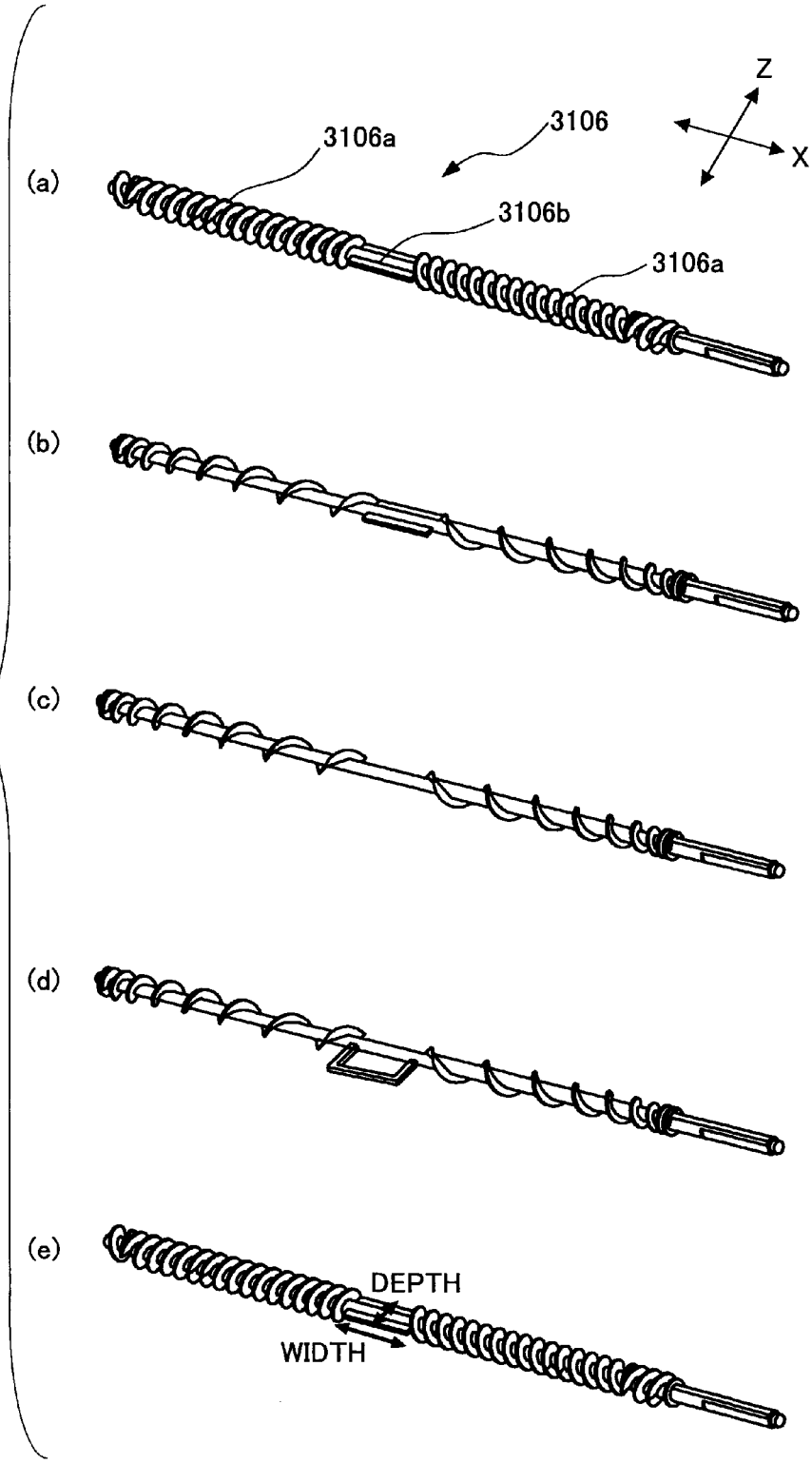
FIG. 21 is a schematic diagram showing examples of an agitating paddle (toner conveying member) according to an embodiment of the present invention.

FIG. 21 shows various examples of the toner conveying member (agitating paddle) 3106 according to an embodiment of the present invention.

In the example of FIG. 21(*a*), the toner conveying member 3106 provides both a toner conveying function and an agitating function. The toner conveying member 3106 has a spiral screw part (hereinafter also referred to as "first unit") 3106*a* on both ends for conveying toner towards the center of the toner conveying member 3106 in the axial direction (X direction). The toner conveying member 3106 also has a second unit for raveling (raveling out) the toner conveyed to the center. Since the second unit ravels (ravels out) the toner at the area above the supplying port 3107, the toner in the toner supplying chamber 3102 is pulled into the toner supplying chamber 3102 by its own weight as the amount of toner in the toner supplying chamber becomes less.

In the example of FIG. 21 (*b*), the flaps (fins) of the first unit 3106*a* are arranged in a manner where the pitch (interval) of the flaps increases towards the second unit 3106*b* at the center of the toner conveying member 3106. Accordingly, by adjusting the pitch (interval) between the flaps of the first unit 3106*a*, the conveying force can be reduced toward the center of the toner conveying member 3106. In other words, since the pitch of the flaps situated above the supplying port 3107 at the center part of the partitioning member 3109 is greater than the pitch of the flaps situated above the other supplying port (s) 3107 at other parts of the partitioning member 3109, the toner conveying force in the substantially horizontal direction (X direction) can be reduced at the vicinity of the supplying port 3197 at the center of the supplying port 3107 of the partitioning member 3109.

In the example of FIG. 21 (*c*), the toner conveying member 3106 has no second unit 3106*b* for raveling (raveling out) the toner at the center of the toner conveying member 3106. Even with this configuration, the toner conveying force can be adjusted by adjusting the pitch (interval) of the flaps of the first unit 3106*a*.

In the example of FIG. 21 (*d*), the second unit 3106*b* is formed in a paddle shape for raveling (raveling out) the toner. In this example, the toner conveying member 3106 is configured as a combination of a spiral screw part and a planar part. With this configuration, while efficiently conveying the toner in a desired direction, the toner can be agitated without generating the conveying force at the area of the second unit 3106*b*.

Figure 22:
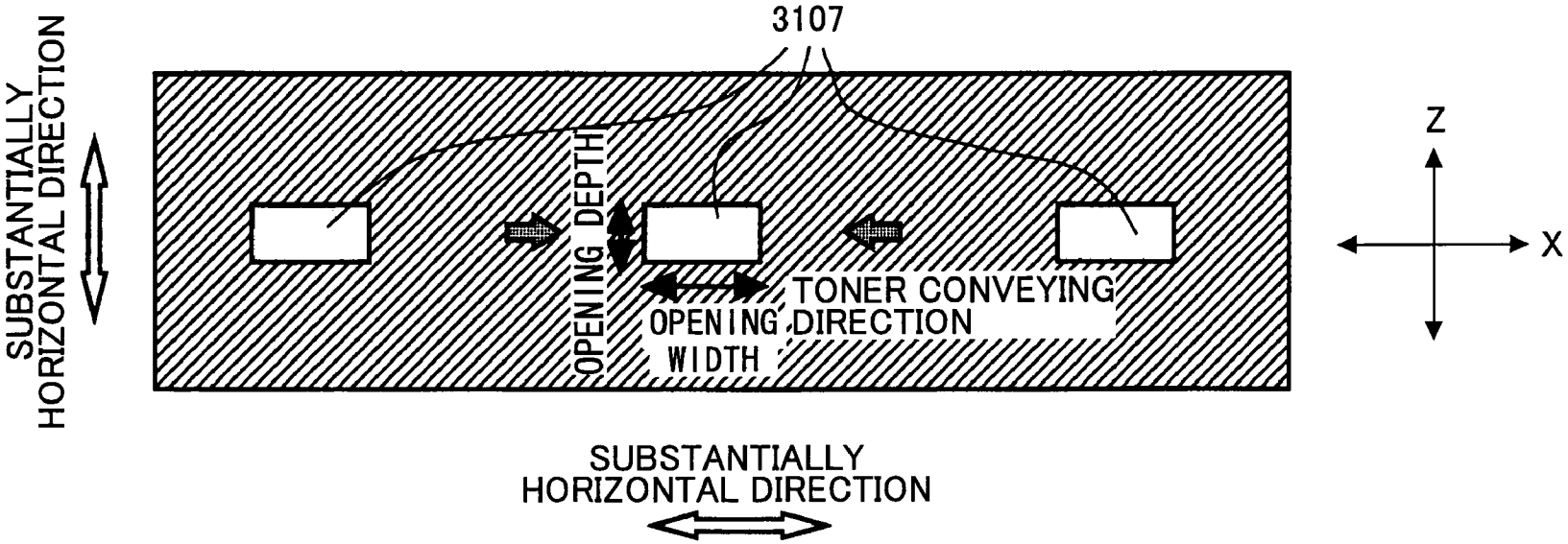
FIG. 22 is a schematic diagram for describing the width and the length of an opening of a partitioning member positioned between a toner storing chamber and a toner supplying chamber according to an embodiment of the present invention.

FIG. 21 (*e*) is a diagram for describing the width and the depth of the second unit 3106*b* of the toner conveying member 3106 according to an embodiment of the present invention. FIG. 22 is a schematic diagram for describing the supplying ports 3107 of the partitioning member 3109 situated between the toner storing chamber 3101 and the toner supplying chamber 3102 according to an embodiment of the present invention. By forming the second unit 3106*b* with a width greater than the width of the supplying port (opening) 3107, the toner conveyed to the vicinity of the supplying port 3107 reduces speed in the substantially horizontal direction upon reaching the area above the supplying port 3107. Furthermore, by forming the second unit 3106*b* with a depth greater than the depth of the supplying port (opening) 3107, the toner conveyed to the area above the supplying port 3107 can be raveled and prevented from accumulating. This prevents problems such as flocculation of toner and packing of toner. As a result, toner can be efficiently supplied to the toner supplying chamber 3102.

The toner used in the developing apparatus 3004 according to an embodiment of the present invention includes particles having at least a binding resin and a coloring agent. Various resins known in the field of electrophotography and electrostatic printing may be used as the binding resin in the toner particle. For example, the binding resin includes styrene type resin; acryl type resin (e.g., alkylacrylate, alkylmetacrylate); styrene-acryl type copolymer resin; polyester type resin; silicon type resin; olefin type resin; amide type resin; and epoxy type resin. In a case of using a full color toner for oil-less fixation, the releasing agent (wax) may include, for example, polyethylene wax, polypropylene wax, carnauba wax, rice wax, sasol wax, montan type wax, fischer-tropsch wax, and paraffin wax. In the case of using full color toner for oil-less fixation, the melting point is 60-100° C., and more preferably 65-90° C. where the wax may be fatty acid ester, low molecular weight polyethylene, carnauba wax, or low melting point paraffin. It is particularly preferable to use low melting point paraffin having low polarity and a high releasing characteristic. In the case of using full color toner for oil-less fixation, the aforementioned releasing agent (wax) is desired to be used. In a case where the melting point of the wax is lower than 60° C., the offset improving effect performance under high temperature deteriorates. In a case where the melting point of the wax is higher than 100° C., the dispersion inside the binding resin becomes insufficient and leads to filming with respect to the photoconductor 3002. In a case of using pulverized toner, the amount of wax to be added to the toner ranges from 3.0 to 10 wt %, and more preferably from 3.5 to 8 wt %. In a case where the amount of wax is below this range, the releasing effect cannot be attained. In a case where the amount of wax is above this range, unsatisfactory dispersion of wax is caused during a melt mixing process and leads to free (detached) wax. This tends to result to the problem of filming. In a case of using wet-granularized toner (capsulation), it is relatively easy to control the arrangement of wax in the toner. Thus, since the wet-granularized toner may be less susceptible to unsatisfactory dispersion of wax or generation of free wax with respect to that of the pulverized toner, the amount of wax added to the toner may be increased to a range from 5 to 12 wt %.

[Part 4]

Figure 23:
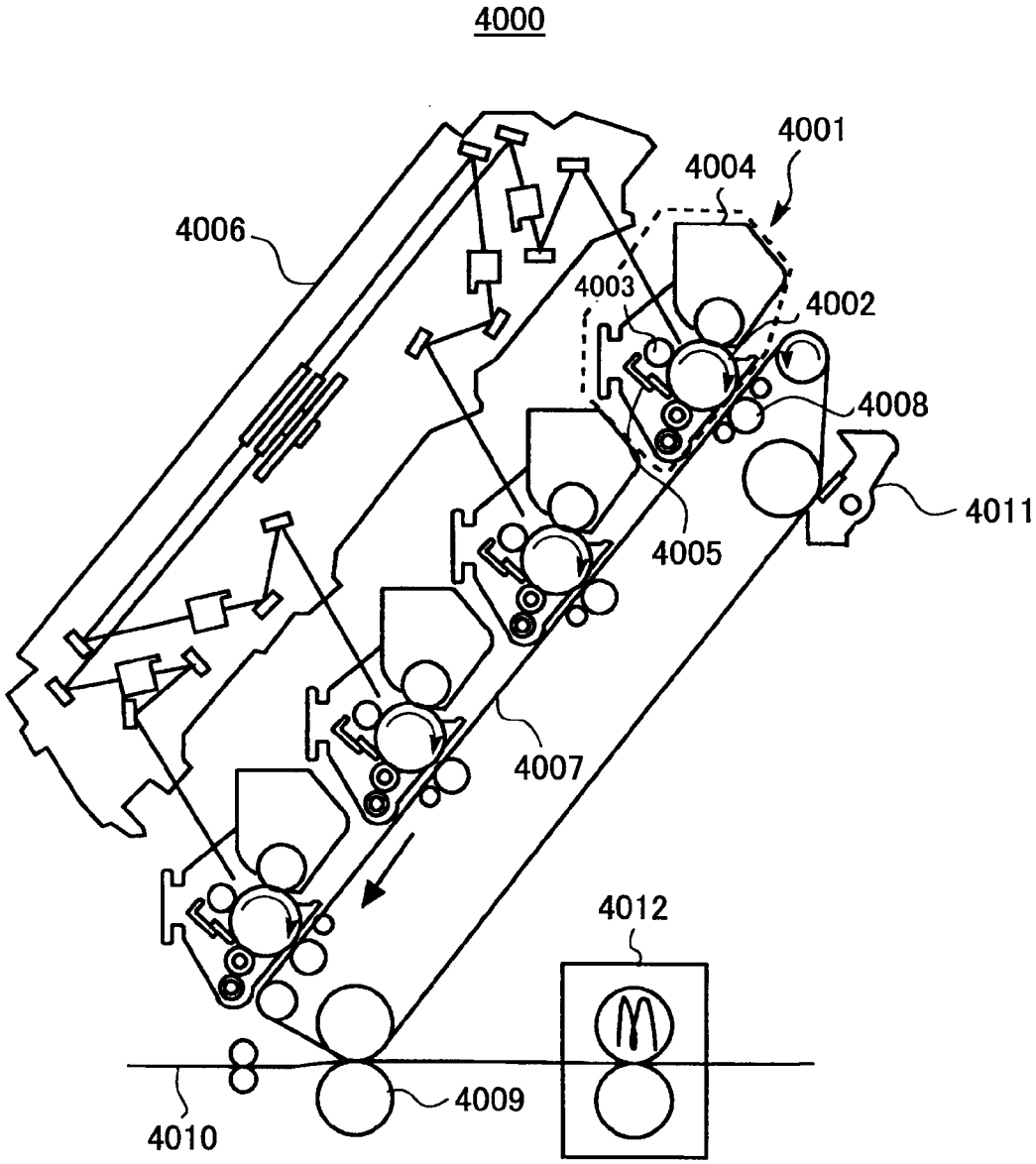
FIG. 23 is a schematic diagram of an image forming apparatus according to an embodiment of the present invention.

Next, an image forming apparatus according to another embodiment of the present invention is described. The image forming apparatus according to this embodiment of the present invention is an electrophotographic type printer (hereinafter also referred as "printer"). FIG. 23 is a schematic diagram showing an image forming apparatus 4000 according to this embodiment of the present invention. The image forming apparatus 4000 includes four process units (process cartridges) 4000 (4001Y, 4001M, 4001C, and 4001K) for forming toner images of yellow, magenta, cyan, and black (hereinafter also indicated as "Y", "M", "C", and "K"). Besides using different color toners (Y, M, C, and K) as a developer, the process units 4001Y, 4001M, 4001C, and 4001K have substantially the same configuration and are replaced upon reaching the end of their lifespan.

A photoconductor 4002K is rotated in a clockwise direction at a linear speed of 150 [mm/sec] by a driving part (not shown). A high voltage is applied to a charging roller 4004K from a high voltage power source (not shown). At the area where the photoconductor 4002K and the charging roller 4004K face each other, the charging roller 4004K electrically discharges with respect to the photoconductor 4002K. Owing to this discharge, the surface of the photoconductor 4002K is uniformly charged to −500 [V]. Then, an electrostatic latent image corresponding to K is carried on the photoconductor 4002K by irradiating and scanning a laser beam L to the photoconductor 4002K. The electrostatic latent image corresponding to K is developed into a toner image corresponding to K by a developing apparatus 4004K using a black (K) toner. Then, the toner image is transferred (intermediary transfer) to an intermediary transfer belt 4016. Then, after the intermediary transfer process, a drum cleaning apparatus 4003K removes residual toner remaining on the surface of the photoconductor 4002K by applying a cleaning brush or a cleaning blade against the surface of the photoconductor 4002K.

Then, after the cleaning process, a charge removing apparatus removes charge remaining on the photoconductor 4002K. After charge removing process is completed, the surface of the photoconductor 4002K returns to its initial state to prepare for the next image forming operation. In the same manner as the process unit 4001K, the other process units 4001Y, 4001M, and 4000C also form a toner image on a photoconductor 4002Y, 4002M, and 4002C and transfer the toner image on the intermediary transfer belt 4016.

In FIG. 23, the image forming apparatus 4000 is a tandem type image forming apparatus for indirectly transferring images onto a recording medium. The image forming apparatus 4000 includes an intermediary transfer belt 4007 serving as an endless belt having its surface moving (rotating) in the arrow direction shown in FIG. 1. Drum-shaped photoconductors 4002 (4002Y, 4002M, 4002C, 4002Bk) for carrying toner images corresponding to Yellow, Magenta, Cyan, and Black (Y, M, C, Bk) are arranged above the intermediary transfer belt 4007 in this order from an upstream side relative to the rotating direction of the intermediary transfer belt 4007. Toner image forming parts including developing apparatuses are positioned at the peripheries of the photoconductors 4002Y, 4002M, 4002C, 4002Bk for forming toner images of corresponding colors. The toner image forming parts are integrally supported together with corresponding photoconductors 4002Y, 4002M, 4002C, and 4002Bk, to thereby form process cartridges 4001 (4001Y, 4001M, 4001C, 4001Bk) that are detachably attached to a main body of the image forming apparatus 4000. The process cartridges 4001Y, 4001M, 4001C, and 4001Bk can be replaced by releasing corresponding stoppers (not shown). An optical writing apparatus 4006 is positioned above the photoconductors 4002Y, 4002M, 4002C, 4002Bk. The optical writing apparatus 4006 is for exposing and scanning a laser beam upon the surfaces of the photoconductors 4002Y, 4002M, 4002C, 4002Bk based on image data. Accordingly, electrostatic latent images corresponding to Y, M, C, and Bk can be formed on the photoconductors 4002Y, 4002M, 4002C, and 4002Bk. Although the optical writing apparatus 4006 according to this embodiment of the present invention is a laser beam scanning type optical writing apparatus using a laser diode, the optical writing apparatus 4006 may also use an array of LEDs. First transfer rollers 4008 (4008Y, 4008M, 4008C, 4008Bk), which serve as first transferring parts, are provided at an inner side of the intermediary transfer belt 4007 situated opposite to the photoconductors 4002Y, 4002M, 4002C, 4002Bk, respectively. The first transfer rollers 4008Y, 4008M, 4008C, and 4008Bk are for transferring toner images formed on the photoconductors 4002Y, 4002M, 4002C, 4002Bk to the intermediary transfer belt 4007. Furthermore, a second transfer roller 4009, which serves as a second transferring part, is provided at a position more downstream relative to the rotating direction of the intermediary transfer belt 4007 than the process cartridges 4001Y, 4001M, 4001C, and 4001Bk. The second transfer roller 4009 is for transferring an image formed on the intermediary transfer belt 4007 onto a recording medium 4010. Furthermore, a fixing apparatus 4012 is provided at a position more downstream relative to a conveying direction of the recording medium 4010 than the second transfer roller 4009. The fixing apparatus 4012 is for fixing unfixed toner (unfixed toner image) onto the recording medium 4010.

Figure 24:
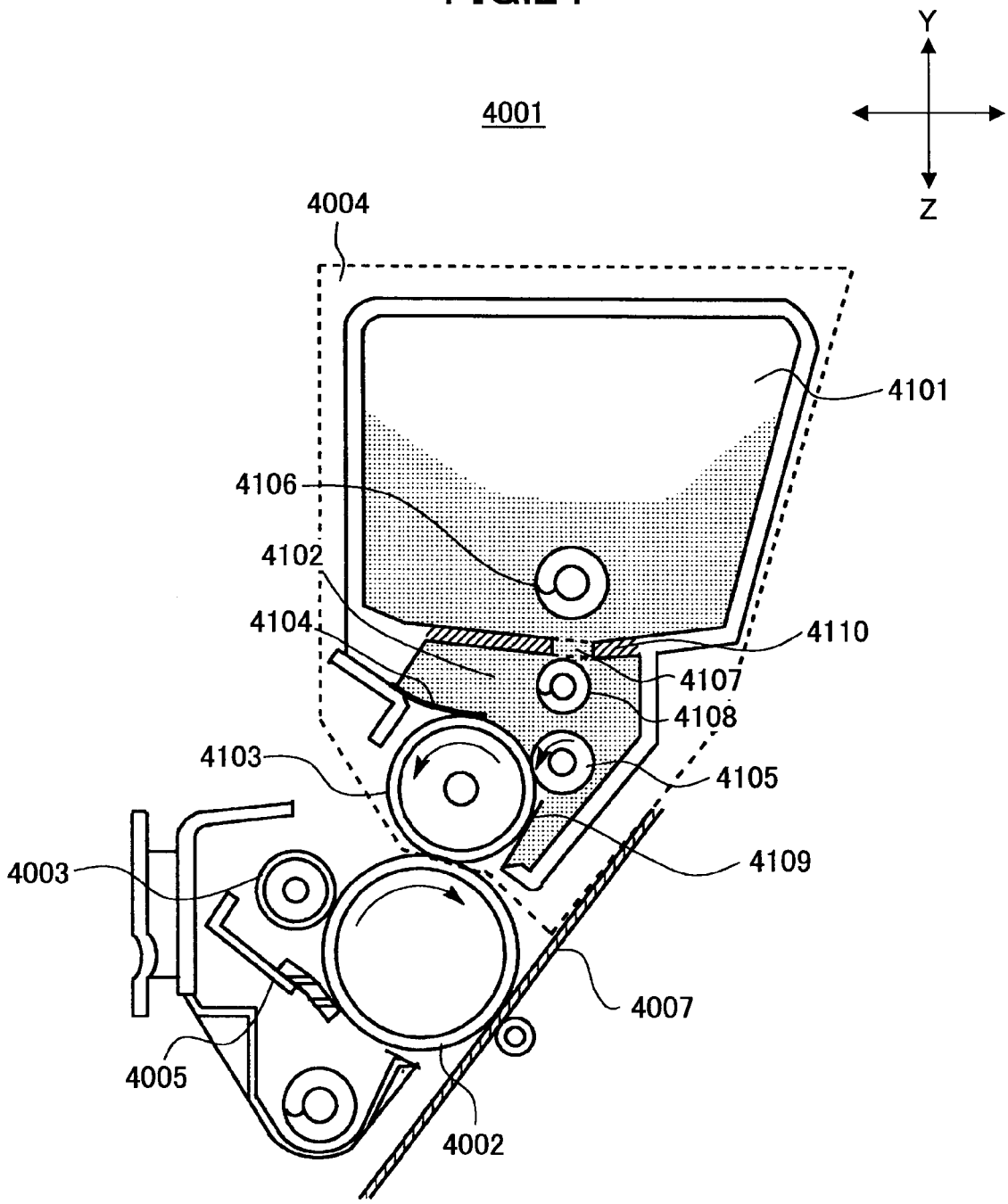
FIG. 24 is a cross-sectional diagram of a process cartridge including a developing apparatus according to an embodiment of the present invention.

FIG. 24 is a cross-sectional diagram showing a process cartridge 4001 (including 4001Y, 4001C, 4001M, and 4001K) having a developing apparatus 4004 according to an embodiment of the present invention. For example, in a case of the process cartridge 4001K for forming a black (K) toner image, the process cartridge 4001K includes a photoconductor (latent image carrier) 4002K, a photoconductor cleaning apparatus 4005K, a charge removing apparatus (not shown), a charging roller 4003K, and a developing apparatus 4004K. The process cartridge 4001K can be detached from the image forming apparatus 4000 for replacement of consumable parts at once. Next, the process cartridge 4001K including the developing apparatus 4004K is described. However, in the description below, the letter K is omitted for the sake of convenience.

The developing apparatus 4004 includes a developer storing chamber 4101 for storing developer therein and a developer supplying chamber 4102 positioned below the developer storing chamber 4101 where a partitioning member 4110 is interposed therebetween for partitioning the developer storing chamber 4101 and the developer supplying chamber 4102. The partitioning member 4110 has plural opening parts. The plural opening parts include a supplying port for supplying developer from the developer storing chamber 4101 to the developer supplying chamber 4102 and a returning port for returning the developer from the developer supplying chamber to the developer storing chamber 4101. A developing roller 4103, a layer restricting member 4104 contacting the developing roller 4103, and a supplying roller 4105 is positioned at a bottom part of the developer supplying chamber 4102. The developing roller 4103 is positioned in a manner contacting the photoconductor 4002. A predetermined developing bias is applied to the developing roller 4103 from a high voltage power source (not shown). A developer conveying member 4106 is provided inside the developer storing chamber 4101.

The developer conveying member 4106 is configured as a rotating shaft having a combination of a spiral wing shape and a planar shape. The developer conveying member 4106 is configured to convey the developer in a substantially horizontal direction and substantially parallel to the developer conveying member 4106. In this example, although the developer conveying member 4106 is described as having a configuration for conveying the developer in a direction substantially parallel to the developer conveying member 2106, the developer conveying member 4106 may be configured as a combination of a conveying part (e.g., a screw, a conveyor belt, or a coiled rotating member) for providing a conveying function and a raveling part (e.g., wing-like planar member or a paddle formed by bending a wire) for providing a raveling function. Furthermore, the developer conveying member 4106 may be configured to convey the developer in a substantially horizontal direction and in a direction substantially perpendicular to the developer conveying member 4106. The opening part 4107 serves as a port for conveying the developer in the developer storing chamber to the developer supplying chamber and a port for returning the developer from the developer supplying chamber to the developer storing chamber. Plural opening parts 4107 are formed in the partitioning member 4110 in a manner substantially parallel to the developing roller 4103. The developer agitating member 4108 is positioned below the opening parts 4107.

The developer agitating member 4108 is configured as a rotating shaft having a combination of a spiral wing shape and a planar shape. The developer conveying member 4106 is configured to convey the developer in a substantially horizontal direction and substantially parallel to the developer conveying member 4106.

The opening parts 4107 formed in the partitioning member 4110 include a supplying port(s) 4107*b* for supplying developer from the developer storing chamber 4101 to the developer supplying chamber 4102 and a returning port(s) 4107*a* for returning the developer from the developer supplying chamber 4102 to the developer storing chamber 4101. The spiral wings of the developer agitating member 4108 are faced in opposite directions at the area directly below the returning port 4107*a*. Since the spiral wings of the developer agitating member 4108 are faced in opposite directions at the area directly below the returning port 4107*a*, the developer, which is gathered (conveyed) to the area below the returning port from both sides, protrudes from the returning port 4107*a* in a mountain-like manner. Furthermore, the developer agitating member 4108 also agitates the developer in the developer supplying chamber 4102 for supplying allowing the developer to be supplied to the developing roller 4103 and the supplying roller 4105 situated at a bottom part of the developer supplying chamber 4102.

The surface of the supplying roller 4105 is covered by a cellular material having pores (cells). The cellular porous configuration of the supplying roller 4105 serves to take (capture) the toner carried into the toner supplying chamber 4102 by adhering the toner and also serves to prevent degradation of toner due to pressure concentrating at the contacting area with respect to the developing roller 4103. A material having an electrical resistance of $10^3$ to $10^{14}$ Ω·cm is used as the cellular material. An offset voltage, which has the same polarity as the charging polarity of the toner with respect to the developing bias, is applied as a supplying bias to the supplying roller 4105. The supplying bias applied to the supplying roller 4105 works to press the preliminarily charged developer against the developing roller 4103 at the contacting area between the supplying roller 4105 and the developing roller 4103. The polarity of the voltage applied to the supplying roller 4105 is not limited to the aforementioned polarity. For example, depending on the type of developer, the voltage applied to the supplying roller 4105 may have the same potential as the developing roller 4103 or have an inverted polarity with respect to the developing roller 4103. The supplying roller 4105 according to an embodiment of the present invention rotates in a counter-clockwise direction, to thereby allow the toner adhered to its surface to coat (cover) the surface of the developing roller 4103.

The developing roller 4103 may be a roller covered by an elastic rubber layer. The developing roller 4103 may further have the surface of the elastic rubber layer coated by a material having a characteristic of being easily charged to a polarity opposite to that of the toner. In order to maintain even contact with respect to the photoconductor (photoconductor drum) 4002, the elastic rubber layer has a degree of hardness that is no greater than 50 degrees (JIS-A). Furthermore, in order for a developing bias to have effect, a material having an electrical resistance of $10^3$ to $10^{10}$ Ω·cm is used as the material of the developing roller 4103. Furthermore, a material having a surface roughness of 0.2 to 2.0 μm (Ra) is used as the material of the developing roller 4103 so that a necessary amount of toner can be retained (held) on the surface of the developing roller 4103. Such developing roller 4103 according to an embodiment of the present invention rotates in a counter-clockwise direction, to thereby allow the toner retained on its surface to be conveyed through the layer thickness restricting member 4104 and finally to the position facing the photoconductor 4002.

The layer thickness restricting member 4104, which uses a metal (e.g., SUS304CSP, SUS301CSP, phosphor bronze) planar spring material, has one end contacting and applying pressure of 10-100 [N/M] to the surface of the developing roller 4103. As the toner on the developing roller 4103 passes through the layer thickness restricting member 4104, the layer thickness of the toner is reduced and charge is applied to the toner by the frictional electricity generated by the pressure applied by the layer thickness restricting member 4104. In order to supplement the frictional electricity, a voltage being offset to the same polarity as the charging polarity of the toner with respect to the potential of the developing roller 4103 is applied as a restriction bias to the layer thickness restricting member 4104.

Since the photoconductor 4002 rotates in the clockwise direction, the surface of the developing roller 4103 advances in the same direction as that of the photoconductor 4002 at the area where the photoconductor 4002 and the developing roller 4103 face each other. After the layer of the toner on the developing roller 4103 is thinned by the layer thickness restricting member 4104, the rotation of the developing roller 4103 conveys the toner the area where the photoconductor 4002 and the developing roller 4103 face each other. At this area, the toner is transferred to the surface of the photoconductor 4002 according to the latent electric field created by the developing bias applied to the developing roller 4103 and the electrostatic latent image formed on the photoconductor 4002. Thereby, the toner is developed.

A sealing member (seal) 4108 is provided in a manner contacting the developing roller 4103 at a portion where residual toner (toner not developed onto the photoconductor 4002) remaining on the developing roller 4103 returns to the inside of the developer supplying chamber 4102. This sealing member 4108 seals the residual toner, so that the toner does not leak outside of the developing apparatus 4004.

Figure 27:
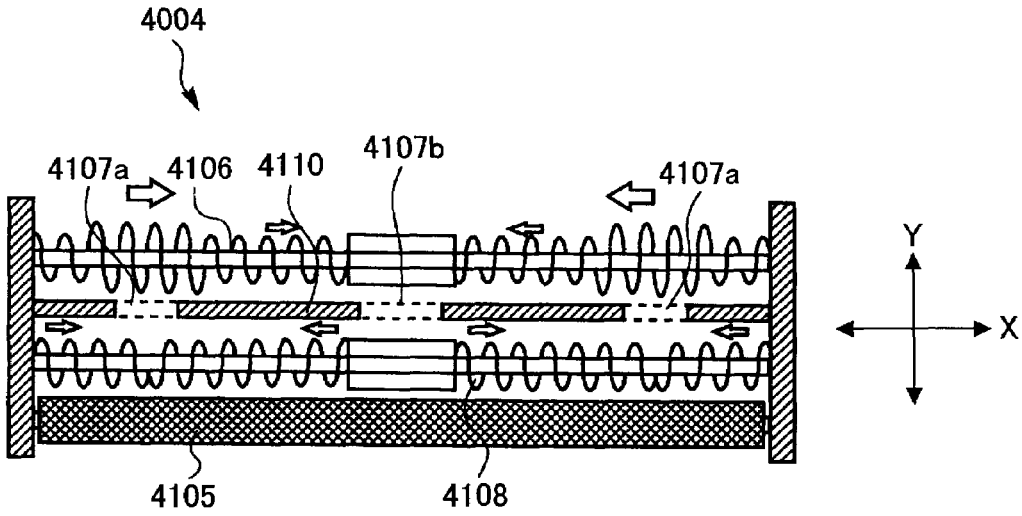
FIG. 27 is a schematic cross-sectional diagram of a developing apparatus according to another embodiment of the present invention.

FIG. 27 is a schematic cross-sectional view of the developing apparatus 4004 according to an embodiment of the present invention. In the developer supplying chamber 4102, the supplying roller 4105 and the developer agitating member 4108 are positioned in this order from the bottom part of the developer supplying chamber 4102. The partitioning member 4110 having the supplying port 4107*b* and the returning port 4107*a* is situated above the developer agitating member 4108 and is interposed between the developer supplying chamber 4102 and the developer storing chamber 4101. Furthermore, the developer conveying member 4106 is positioned above the partitioning member 4110. At the area below the partitioning member 4110, the developer inside the developer supplying chamber 4102 is gathered by the developer agitating member 4108.

Figure 25:
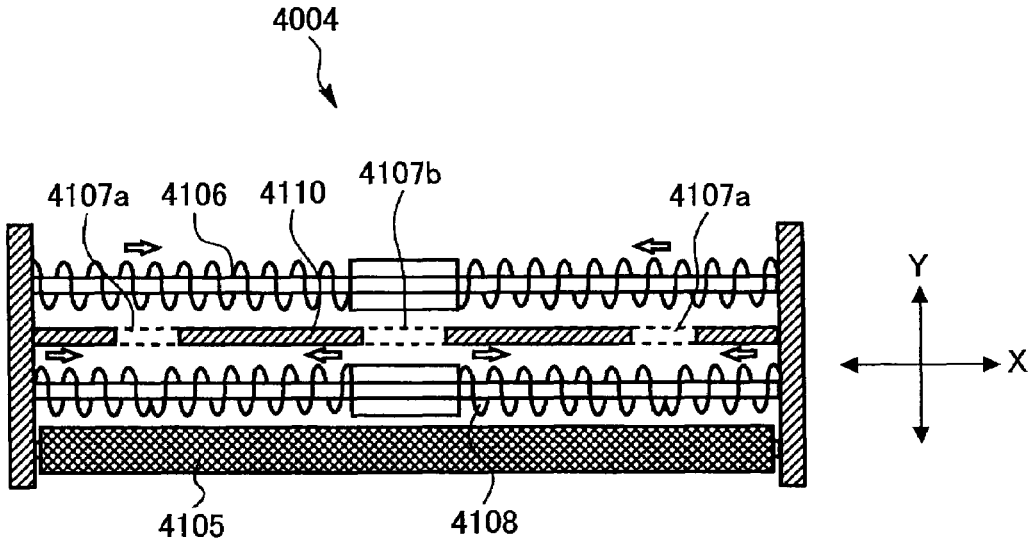
FIG. 25 is a schematic cross-sectional diagram of a developing apparatus according to an embodiment of the present invention.

The gathered developer forms a mountain-like protrusion directly below the returning port 4107*a*. Accordingly, a part of the developer is returned to the developer storing chamber 4101 through the returning port 4107*a*. Then, the returned developer is successively conveyed to the supplying port 4107*b* by the developer conveying member 4106. Although the configuration shown in FIG. 25 illustrates the developing apparatus 4004 having one supplying port 4107*b* positioned at the middle and two returning ports 4107*a* positioned at both sides, the position and the number of the opening parts 4107 (4107*a*, 4107*b*) are not limited to those illustrated in FIG. 25.

Figure 26:
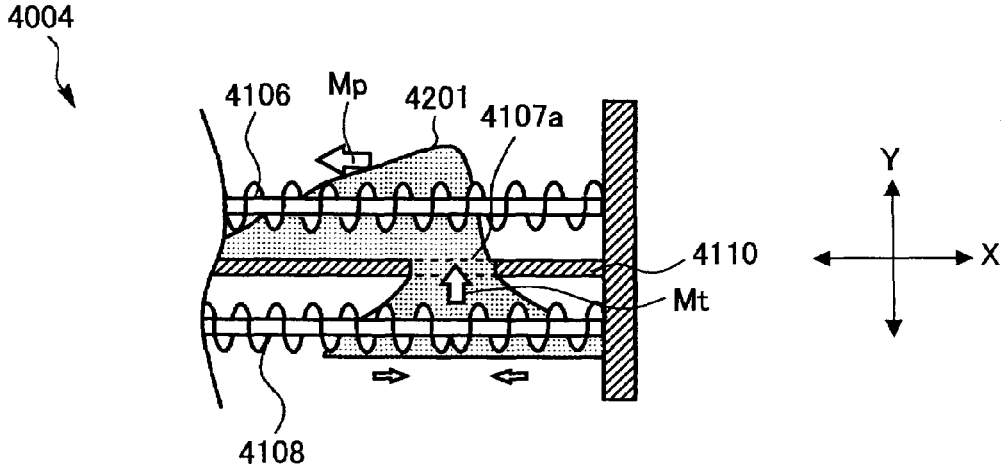
FIG. 26 is a schematic diagram for a relationship between a developer conveying amount Mt conveyed by a developer agitating member and a developer conveying amount Mp conveyed by a developer conveying member Mp according to an embodiment of the present invention.

FIG. 26 is a schematic diagram for describing a relationship between the amount of developer (Mt) conveyed by the developer agitating member 4108 and the amount of returned developer (Mp) conveyed by the developer conveying member 4106. In FIG. 26, "Mt" represents the conveying amount of developer conveyed to the returning port 4107*a* by the developer agitating member 4108 and "Mp" represents the conveying amount of developer gathered from the returning port 4107*a* by the developer conveying member 4106. The developer (indicated with reference numeral "201" in this example), which is collected and conveyed into the returning port 4107*a* by the developer agitating member 4108, is conveyed in a substantially horizontal direction (X direction) by the developer conveying member 4106 after passing through the returning port 4107*a*. In this case, the pitch of the wings (screw pitch), the outer diameter, and/or the number of rotation of the developer conveying member 4106 or the developer agitating member 4108 are controlled so that a relationship of "Mp>Mt" is substantially constantly satisfied.

Accordingly, by maintaining the relationship of "Mp>Mt" by controlling the amount of developer conveyed to at least one of the returning ports 107*a* by the developer agitating member 4108 (Mt) and the amount of developer conveyed by the developer conveying member 4106 (Mp), the developer excessively supplied to the developer supplying chamber 4102 can be efficiently conveyed back to the developer storing chamber 4101 from the developer supplying chamber 4102. Furthermore, the developer inside the developer storing chamber 4101 and the developer supplying chamber 4102 can be partly prevented from degrading. Thereby, a consistent (steady) property can be attained for the developer inside the developing apparatus 4004 for a long period.

It is preferable for the developer conveying member 4106 to be configured to convey the developer so that a greater amount of developer is conveyed at the area above the returning port 4107*a* than the amount of developer conveyed at the areas other than the area above the returning port 4107*a*. This allows the developer in the vicinity of the returning port 4107*a* to be efficiently gathered and at the same time prevent developer from being excessively supplied to the supplying port 4107*b* since there the developer is conveyed with lesser force at the areas other than the vicinity of the returning port 4107*a*. As a result, the powder pressure of the developer can be prevented from becoming high at the vicinity of the supplying port 4107*b*. This prevents the problem in which developer is excessively supplied to the developer supplying chamber 4102 due to the powder pressure of the developer at the vicinity of the supplying port 4107*b*.

Since developer is conveyed through the returning port 4107*a* by positioning the partitioning member having plural opening parts 4107 (4107*a*, 4107*b*) between the developer storing chamber 4101 and the developer supplying chamber 4102 and below the developer conveying member 4106, developer can be efficiently collected (returned) from the developer supplying chamber 4102 to the developer storing chamber 4101. Furthermore, in a case where the developer conveyed from the developer agitating member 4108 in the developer supplying chamber 4102 concentrates at the vicinity of the returning port 4107*a*, the powder pressure of the developer at the vicinity of the returning port can be prevented from becoming high by enabling the developer conveying member 4106 to convey a greater amount of developer in an axial direction at the vicinity of the returning port 4107*a* than at the parts other than the vicinity of the returning port 4107*a*. Thereby, developer can be prevented from accumulating or blocking at the vicinity of the returning port 4107*a*. Thus, the developer can be satisfactorily circulated. That is, a smooth developer circulation system can be attained.

FIG. 27 is a schematic cross-sectional diagram of the developing apparatus 4004 according to another embodiment of the present invention. In the developer conveying member 4106 according to this embodiment of the present invention, the wing parts of the developer conveying member 4106 situated above the supplying port 4107*a* have a greater diameter than the other wing parts of the developer conveying member 4106. Thereby, developer can be conveyed with greater force in the axial direction (X direction) of the developer conveying member at the area above the returning port 4107*a*. This allows the developer in the vicinity of the returning port 4107*a* to be efficiently gathered and at the same time prevent developer from being excessively supplied to the supplying port 4107*b* since there the developer is conveyed with lesser force at the areas other than the vicinity of the returning port 4107*a*. As a result, the powder pressure of the developer can be prevented from becoming high at the vicinity of the supplying port 4107*b*. This prevents the problem in which developer is excessively supplied to the developer supplying chamber 4102 due to the powder pressure of the developer at the vicinity of the supplying port 4107*b*. Thereby, developer can be prevented from accumulating or blocking at the vicinity of the returning port 4107*a*. Thus, the developer can be satisfactorily circulated. That is, a smooth developer circulation system can be attained.

Figure 28:
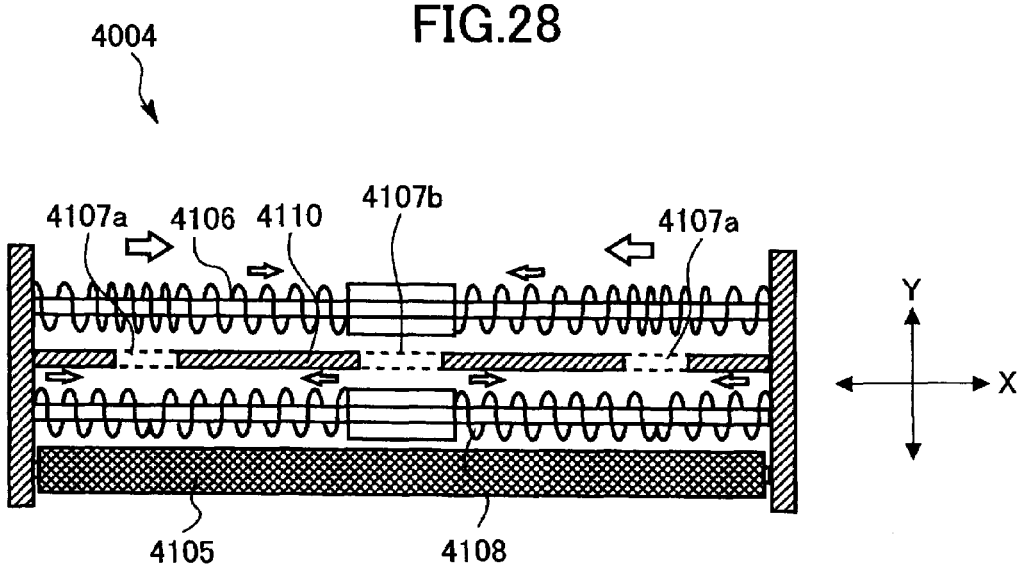
FIG. 28 is a schematic cross-sectional diagram of a developing apparatus according to yet another embodiment of the present invention.

FIG. 28 is a schematic cross-sectional diagram of the developing apparatus 4004 according to yet another embodiment of the present invention. In the developer conveying member 4106 according to this embodiment of the present invention, the wing parts of the developer conveying member 4106 situated above the supplying port 4107*a* are arranged with a smaller pitch (interval) than the other wing parts of the developer conveying member 4106. Thereby, developer can be conveyed with greater force in the axial direction (X direction) of the developer conveying member at the area above the returning port 4107*a*. This allows the developer in the vicinity of the returning port 4107*a* to be efficiently gathered and at the same time prevent developer from being excessively supplied to the supplying port 4107*b* since there the developer is conveyed with lesser force at the areas other than the vicinity of the returning port 4107*a*. As a result, the powder pressure of the developer can be prevented from becoming high at the vicinity of the supplying port 4107*b*. This prevents the problem in which developer is excessively supplied to the developer supplying chamber 4102 due to the powder pressure of the developer at the vicinity of the supplying port 4107*b*. Thereby, developer can be prevented from accumulating or blocking at the vicinity of the returning port 4107*a*. Thus, the developer can be satisfactorily circulated. That is, a smooth developer circulation system can be attained.

The toner used in the developing apparatus 4004 according to an embodiment of the present invention includes particles having at least a binding resin and a coloring agent. Various resins known in the field of electrophotography and electrostatic printing may be used as the binding resin in the toner particle. For example, the binding resin includes styrene type resin; acryl type resin (e.g., alkylacrylate, alkylmetacrylate); styrene-acryl type copolymer resin; polyester type resin; silicon type resin; olefin type resin; amide type resin; and epoxy type resin. In a case of using a full color toner for oil-less fixation, the releasing agent (wax) may include, for example, polyethylene wax, polypropylene wax, carnauba wax, rice wax, sasol wax, montan type wax, fischer-tropsch wax, and paraffin wax. In the case of using full color toner for oil-less fixation, the melting point is 60-100° C., and more preferably 65-90° C. where the wax may be fatty acid ester, low molecular weight polyethylene, carnauba wax, or low melting point paraffin. It is particularly preferable to use low melting point paraffin having low polarity and a high releasing characteristic. In the case of using full color toner for oil-less fixation, the aforementioned releasing agent (wax) is desired to be used. In a case where the melting point of the wax is lower than 60° C., the offset improving effect performance under high temperature deteriorates. In a case where the melting point of the wax is higher than 100° C., the dispersion inside the binding resin becomes insufficient and leads to filming with respect to the photoconductor 4002. In a case of using pulverized toner, the amount of wax to be added to the toner ranges from 3.0 to 10 wt %, and more preferably from 3.5 to 8 wt %. In a case where the amount of wax is below this range, the releasing effect cannot be attained. In a case where the amount of wax is above this range, unsatisfactory dispersion of wax is caused during a melt mixing process and leads to free (detached) wax. This tends to result to the problem of filming. In a case of using wet-granularized toner (capsulation), it is relatively easy to control the arrangement of wax in the toner. Thus, since the wet-granularized toner may be less susceptible to unsatisfactory dispersion of wax or generation of free wax with respect to that of the pulverized toner, the amount of wax added to the toner may be increased to a range from 5 to 12 wt %.

Further, the present invention is not limited to these embodiments, but variations and modifications may be made without departing from the scope of the present invention.

The present application is based on Japanese Priority Application Nos. 2006-327004, 2006-331066, 2007-008672, and 2007-026789 filed on Dec. 4, 2006, Dec. 7, 2006, Jan. 18, 2007, and Feb. 6, 2007, respectively, with the Japanese Patent Office, the entire contents of which are hereby incorporated by reference.

What is claimed is:

1. A developing apparatus including a developer carrier, a supplying chamber configured to supply the developer to the developer carrier, and a storing chamber positioned above the supplying chamber and configured to store the developer; the developing apparatus comprising:

a partitioning member positioned between the supplying chamber and the storing chamber, the partitioning member having a supplying port configured to supply the developer from the storing chamber to the supplying chamber and a returning port configured to return the developer from the supplying chamber to the storing chamber;

a first rotating member that is provided in the storing chamber and that is configured to convey the developer in an axial direction;

a second rotating member that is provided in the supplying chamber and that is configured to convey the developer in the axial direction, wherein the second rotating member is positioned directly below the returning port;

wherein the second rotating member has a plurality of wings having inclinations that are inverted at an area directly below the returning port; and wherein when a distance between a bottom tip of the second rotating member and the partitioning member is "G", a maximum width of the returning port in the axial direction is "Wp", and a repose angle of the developer is "θ", the width of the returning port satisfies a relationship of "$\theta > \tan-1(2G/Wp)$.

2. The developing apparatus as claimed in claim 1, wherein the second rotating member conveys the developer to form a protrusion from directly below the returning port, wherein when a width of a part of the protrusion located at substantially the same height as the returning port is "Wt" and the maximum width of the returning port in the axial direction is "Wp", a relationship of "Wt>Wp" is satisfied.

3. The developing apparatus as claimed in claim 1, wherein in a case where the returning port is divided into an inward part and an outward part by a line running through the center of the inverted inclinations of the wings of the second rotating member, an area of the inward part and an area of the outward part satisfy a relationship of "Si≧So", wherein "Si" is the area of the inward part and "So" is the area of the outward part.

4. The developing apparatus as claimed in claim 1, wherein the second rotating member and the returning port satisfy a relationship of "D>Wd", wherein "D" is an outer diameter of the second rotating member and "Wd" is the width of the returning port in a direction perpendicular to the axial direction.

5. A process cartridge comprising:

a developing apparatus including a developer carrier, a supplying chamber configured to supply the developer to the developer carrier, and a storing chamber positioned above the supplying chamber and configured to store the developer; the developing apparatus including:

a partitioning member positioned between the supplying chamber and the storing chamber, the partitioning member having a supplying port configured to supply the developer from the storing chamber to the supplying chamber and a returning port configured to return the developer from the supplying chamber to the storing chamber;

a first rotating member that is provided in the storing chamber and that is configured to convey the developer in an axial direction;

a second rotating member that is provided in the supplying chamber and that is configured to convey the developer in the axial direction, wherein the second rotating member is positioned directly below the returning port;

wherein the second rotating member has a plurality of wings having inclinations that are inverted at an area directly below the returning port; and wherein when the distance between a bottom tip of the second rotating member and the partitioning member is "G", the maximum width of the returning port in the axial direction is "Wp", and the repose angle of the developer is "θ", the width of the returning port satisfies a relationship of "θ>tan−1(2G/Wp).

6. The process cartridge as claimed in claim 5, wherein the second rotating member conveys the developer to form a protrusion from directly below the returning port, wherein when a width of a part of the protrusion located at substantially the same height as the returning port is "Wt" and the maximum width of the returning port in the axial direction is "Wp", a relationship of "Wt>Wp" is satisfied.

7. The process cartridge as claimed in claim 5, wherein in a case where the returning port is divided into an inward part and an outward part by a line running through the center of the inverted inclinations of the wings of the second rotating member, an area of the inward part and an area of the outward part satisfy a relationship of "Si≧So", wherein "Si" is the area of the inward part and "So" is the area of the outward part.

8. The process cartridge as claimed in claim 5, wherein the second rotating member and the returning port satisfy a relationship of "D>Wd", wherein "D" is an outer diameter of the second rotating member and "Wd" is the width of the returning port in a direction perpendicular to the axial direction.

9. An image forming apparatus comprising:

a developing apparatus including a developer carrier, a supplying chamber configured to supply the developer to the developer carrier, and a storing chamber positioned above the supplying chamber and configured to store the developer; the developing apparatus including:

a partitioning member positioned between the supplying chamber and the storing chamber, the partitioning member having a supplying port configured to supply the developer from the storing chamber to the supplying chamber and a returning port configured to return the developer from the supplying chamber to the storing chamber;

a first rotating member that is provided in the storing chamber and that is configured to convey the developer in an axial direction;

a second rotating member that is provided in the supplying chamber and that is configured to convey the developer in the axial direction, wherein the second rotating member is positioned directly below the returning port;

wherein the second rotating member has a plurality of wings having inclinations that are inverted at an area directly below the returning port; and wherein when the distance between a bottom tip of the second rotating member and the partitioning member is "G", the maximum width of the returning port in the axial direction is "Wp", and the repose angle of the developer is "θ", the width of the returning port satisfies a relationship of "θ>tan−1(2G/Wp).

10. The image forming apparatus as claimed in claim 9, wherein the second rotating member conveys the developer to form a protrusion from directly below the returning port, wherein when a width of a part of the protrusion located at substantially the same height as the returning port is "Wt" and the maximum width of the returning port in the axial direction is "Wp", a relationship of "Wt>Wp" is satisfied.

11. The image forming apparatus as claimed in claim 9, wherein in a case where the returning port is divided into an inward part and an outward part by a line running through the center of the inverted inclinations of the wings of the second rotating member, an area of the inward part and an area of the outward part satisfy a relationship of "Si≧So", wherein "Si" is the area of the inward part and "So" is the area of the outward part.

12. The image forming apparatus as claimed in claim 9, wherein the second rotating member and the returning port satisfy a relationship of "D>Wd", wherein "D" is an outer diameter of the second rotating member and "Wd" is the width of the returning port in a direction perpendicular to the axial direction.

* * * * *